US008136909B2

(12) United States Patent
Ogasawara et al.

(10) Patent No.: US 8,136,909 B2
(45) Date of Patent: Mar. 20, 2012

(54) INK JET PRINTING APPARATUS AND INK PROCESSING METHOD FOR SAME

(75) Inventors: Masashi Ogasawara, Tokyo (JP); Mikio Sanada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1311 days.

(21) Appl. No.: 11/721,885

(22) PCT Filed: Dec. 27, 2005

(86) PCT No.: PCT/JP2005/024227

§ 371 (c)(1),
(2), (4) Date: Jun. 15, 2007

(87) PCT Pub. No.: WO2006/070919

PCT Pub. Date: Jul. 6, 2006

(65) Prior Publication Data

US 2008/0136857 A1 Jun. 12, 2008

(30) Foreign Application Priority Data

Dec. 28, 2004 (JP) ..... 2004-381748

(51) Int. Cl.
*B41J 29/377* (2006.01)

(52) U.S. Cl. ..... 347/18; 347/2; 347/7; 347/17; 347/21; 347/22; 347/23; 347/29; 347/30; 347/31; 347/35; 347/36; 347/89; 347/95; 347/96; 347/97

(58) Field of Classification Search ..... 347/7, 89, 347/33, 2, 17–18, 21–23, 29–31, 35–36, 347/95–97

See application file for complete search history.

(56) References Cited

U.S. PATENT DOCUMENTS

| | | | | |
|---|---|---|---|---|
| 5,221,935 | A | 6/1993 | Uzita | |
| 5,532,720 | A * | 7/1996 | Krueger et al. | 347/7 |
| 5,969,731 | A | 10/1999 | Michael et al. | |
| 5,996,354 | A | 12/1999 | Sokolean et al. | |
| 6,224,186 | B1 | 5/2001 | Johnson et al. | |

(Continued)

FOREIGN PATENT DOCUMENTS

JP 54-051837 4/1979

(Continued)

OTHER PUBLICATIONS

U.S. Appl. No. 60/576,047 to Sliwa filed Jun. 1, 2004, now Patent 7682009.*

(Continued)

*Primary Examiner* — Ryan Lepisto
*Assistant Examiner* — Guy Anderson
(74) *Attorney, Agent, or Firm* — Fitzpatrick, Cella, Harper & Scinto

(57) ABSTRACT

In an ink jet print head formed with ejection nozzles, which may use a wiping member to wipe ink adhered to the surface of the ink jet print head, it is desired to be able to perform a wiping operation in any environment without requiring a large amount of space to accommodate the liquid used during the wiping operation. To this end, a cooling unit is used which can produce water by cooling the atmosphere. This cooling unit is operated to produce water, which is brought into contact with and transferred onto the wiping member before the wiping member performs wiping.

10 Claims, 16 Drawing Sheets

U.S. PATENT DOCUMENTS

| | | | | |
|---|---|---|---|---|
| 6,520,621 | B1 | 2/2003 | Eckard et al. | |
| 6,536,863 | B1 * | 3/2003 | Beauchamp et al. | 347/17 |
| 6,588,892 | B1 * | 7/2003 | Stramel et al. | 347/102 |
| 6,643,220 | B2 * | 11/2003 | Anderson et al. | 367/34 |
| 7,682,009 | B1 * | 3/2010 | Sliwa et al. | 347/95 |
| 7,744,767 | B2 * | 6/2010 | Driggers | 210/801 |
| 2007/0247484 | A1 | 10/2007 | Sanada et al. | |

FOREIGN PATENT DOCUMENTS

| | | | |
|---|---|---|---|
| JP | 57-057667 | | 4/1982 |
| JP | 4-211963 | A | 8/1992 |
| JP | 7-276651 | A | 10/1995 |
| JP | 8-025648 | A | 1/1996 |
| JP | 8-150712 | A | 6/1996 |
| JP | 8-150734 | A | 6/1996 |
| JP | 2547929 | | 5/1997 |
| JP | 10-138503 | | 5/1998 |
| JP | 10-506705 | T | 6/1998 |
| JP | 11-316527 | A | 11/1999 |
| JP | 2000-203037 | | 7/2000 |
| JP | 2000-276214 | | 10/2000 |
| JP | 2001-105581 | A | 4/2001 |
| JP | 2001-315360 | A | 11/2001 |
| JP | 2002-055575 | A | 2/2002 |
| JP | 2002-166562 | A | 6/2002 |
| JP | 2003-054052 | A | 2/2003 |
| JP | 2003-313010 | A | 11/2003 |
| JP | 2004-243663 | A | 9/2004 |
| JP | 2004-306278 | A | 11/2004 |

OTHER PUBLICATIONS

International Preliminary Report on Patentability in PCT/JP2005/024227.

Japanese Office Action dated Mar. 25, 2011, issued in counterpart Japanese patent application No. 2005-375948.

* cited by examiner

INK JET PRINTING APPARATUS AND INK PROCESSING METHOD FOR SAME

TECHNICAL FIELD

The present invention relates to a printer for industrial and home use using a commercially available aqueous ink (ink containing a colorant such as dye, pigment and dye-pigment mixture and ink not containing these). More particularly, the present invention relates to an ink jet printing apparatus suitably used as the above printer and to an ink processing method for the ink jet printing apparatus. The invention further relates to a technique suitably applied to the ink processing performed during a maintenance of the printing apparatus.

BACKGROUND ART

The ink jet printing system suitably applicable to industrial and home use printers using the above aqueous ink is a system that transforms input image data into an output image by means of a liquid ink. A technique for maintaining performance of an ink ejecting print head is important from the standpoint of reliability of a printing operation and is employed for the following reasons.

(a) An ink ejection print head ejects ink directly onto a print medium from its fine nozzles (which generally refer to ink ejection openings, liquid paths communicating with the openings and elements that generate energy for ejecting ink). The ejected ink, when it lands on the print medium, may bounce off it. Further, during the ink ejection operation, fine ink droplets (satellite or secondary droplets) may be ejected from the print head in addition to the main ink droplets intended to form an image and may drift in the atmosphere. These fine droplets form ink mist which in turn may adhere to around the ink ejection openings of the print head. The ink that settled around the ejection openings may pull the main ink droplets as they are ejected, deflecting a direction of the ejecting droplets, i.e., interfering with the main ink droplets flying in straight line.

(b) The print head generally has a plurality of nozzles arrayed therein for the purpose of increasing the printing speed and resolution. Depending on input image data, there may be nozzles during the printing operation that are not used for ink ejection. From the ejection openings of such nozzles an ink solvent evaporates to increase a viscosity of ink in these nozzles. Therefore, when the nozzles in question are used thereafter, the print head may not be able to eject ink stably when applied a normal ink ejection energy, resulting in an ejection failure. Further, if bubbles exist in ink reservoirs inside the print head, i.e., in the liquid paths on the inner side of the nozzles or in a common chamber communicating with the liquid paths, a gas that has passed through the ejection openings and the interior of a member forming the print head may get trapped in the bubbles which in turn grow in size. The bubbles may also inflate due to a temperature increase during the printing operation. These will interfere with normal ink supply from an ink source, causing an ink ejection failure.

As a maintenance technique to solve the problems described in (a) and (b), the following is employed in the ink jet printing apparatus.

(A) A surface of the print head on which ejection openings are formed (hereinafter referred to as an ejection face) is wiped with a wiping member formed of an elastic material such as rubber, at a predetermined timing to remove adhering ink (this operation is called a wiping).

(B) Aside from the ink ejection for forming an image on a print medium, a predetermined amount of ink is ejected to discharge ink of an increased viscosity according to the time in which ink ejection is not performed and an environment (this operation is called a preliminary ejection). Also, a suction force is applied to the ejection face at a predetermined timing, as by operating a pump, to forcibly suck out ink from an inner part of the nozzles through the ejection openings (this operation is called a suction-based recovery). The ejected or sucked-out ink (hereinafter called waste ink) is received in a cap which can oppose the ejection face or which can form a hermetic space around the ejection openings. The waste ink is then moved to and retained in an absorbent installed at a predetermined location.

Among aqueous inks commercially available in recent years (that may or may not include colorants such as dye, pigment and dye-pigment mixture), there is an ink containing a pigment as the colorant (pigment-based ink) which is developed to meet a demand for an increased image fastness. Compared with an ink containing dye (dye-based ink), the pigment-based ink is less capable of re-dispersing a colorant after evaporation and has a characteristic that a high molecular compound used to disperse the pigment in a solvent is easily adsorbed to the ejection face.

In the printing apparatus using the pigment-based ink, therefore, simply wiping the ejection face of the print head may leave ink, whose viscosity was increased by the evaporation of ink solvent, on the ejection face. As a result, the problem (a) may not be alleviated. The pigment-based ink is made by dispersing a solid colorant in water as by using a dispersant or introducing a functional group to a pigment surface. Thus, a dry substance of the pigment-based ink whose water content has dried on the ejection face has a greater damaging effect on the ejection face than a dry substance of the dye-based ink which has the colorant itself dissolved at a molecular level. The pigment-based ink is also characterized in that the high molecular compound used to disperse the pigment in a solvent is easily adsorbed to the ejection face. This problem also occurs in other than the pigment-based ink whenever high molecular compounds exist in the ink as a result of adding a reaction liquid to the ink for adjustment of ink viscosity, for improvement of lightfastness or for other purposes.

To cope with these problems, Japanese Patent Application Laid-open Nos. 10-138503 and 2000-203037 disclose a technique that applies liquid for a head (hereinafter called 'head liquid') to the ejection face during the print head wiping operation. This alleviates a wear of the wiper, dissolves ink residues adhering to the print head to remove them, and forms a thin film of head liquid on the print head to prevent foreign matters from adhering to the print head. As a result, the wiping performance is improved. The head liquid used for wiping is stored in the interior of the printer body. Further, the Japanese Patent Application Laid-open Nos. 10-138503 and 2000-203037 disclose a step of cleaning the ejection face by moving the wiper relative to the ejection face and a step of supplying, before the cleaning step, a nonvolatile solvent as the head liquid to the ejection face. These documents, however, offer a very limited description on the nonvolatile solvent. That is, the Japanese Patent Application Laid-open Nos. 10-138503 and 2000-203037 only disclose polyethyleneglycol (PEG) with a molecular weight of 200-600 and polyethyleneglycol (PEG300) with a molecular weight of 300, respectively.

As to the use of cooling means in the ink jet printing technology, the following is available. Japanese Patent Application Laid-open No. 54-51837 discloses a technique that forms a bubble by a nucleate boiling and cools to collapse the bubble in a very short time or in microseconds by using a Peltier device. Even if a balance between heat dissipation and cooling and products on the market are observed, it is thought that such a Peltier device has yet to come out of a primordial stage of idea. On the other hand, Japanese Patent Application Laid-open No. 2000-276214 discloses a Peltier device provided on the outside of a cap member with a seal portion, which is adapted to open to the nozzle face (ejection face) of the print head, for the purpose of preventing a possible clogging of a group of nozzles arrayed on the print head in the ink jet printing apparatus. The Japanese Patent Application Laid-open No. 2000-276214 improves the humidity inside the cap to prevent the nozzle clogging. This technology, however, cannot improve the humidity in the cap when the cooling operation is performed with the nozzles capped. Conversely, if the cap is cooled before the capping operation, no desirable response can be expected nor can an absolute humidity enough to prevent head clogging be obtained because the cap has a communication tube for discharging ink.

In another field separate from the ink jet printing, Japanese Utility Model Registration No. 2547929 discloses a construction in which a Peltier device is used to cool to −15° C. to −20° C. a pen point which comes into contact with a print medium that produces color upon cooling. The Japanese Utility Model Registration No. 2547929 has a description that any condensed dew layer or water drop adhering to the pen point will degrade the quality of a thermally transformable object, suggesting that a dew condensation should be avoided.

The print head cleaning device described in the Japanese Patent Application Laid-open No. 10-138503, however, must be provided with a reservoir for storing a sufficient amount of nonvolatile solvent to be applied to the wiper during the wiping operation that is performed until the end of life of the printer body. This poses a problem of an increased size of the printer. Although the size of the printer may be reduced by adopting a construction that the nonvolatile solvent is periodically replenished, the user is required to perform the cumbersome processing. If a processing liquid available in the market is used, the running cost can increase. Further, depending on the environment in which the printer is used, the nonvolatile solvent may become dry or wet, changing its property, which in turn results in variations in the amount of solvent applied to the wiper and therefore a possibility of a desired wiping performance failing to be produced.

Further, the Japanese Patent Application Laid-open No. 10-138503 is primarily concerned with the application of the nonvolatile solvent to the wiper and is not aware of the problem that a waste ink introducing portion of an absorbent is blocked by a viscous ink or solidified ink and that this prevents the waste ink from spreading into the interior of the absorbent, resulting in an overflow of the waste ink. Naturally, a solution to this problem is not suggested.

As for the problem (b) described above, as a waste ink is introduced into the absorbent, viscous ink and, in a worse case, solidified ink accumulate at the waste ink introducing portion of the absorber. Therefore, the waste ink introducing portion may be blocked, preventing the infiltration of waste ink into the interior of the absorbent, which in turn may result in an overflow of waste ink.

DISCLOSURE OF THE INVENTION

A main object of this invention is to provide a novel mechanism and method for substantially and efficiently adding water directly or indirectly to an ink discharged from a print head (excluding the ink used to form an image) which is in a liquid or viscous state, thereby alleviating the undesirable state of the discharged ink and facilitating ink processing. Another object of this invention is to maintain a desired ink processing performance of a maintenance mechanism, such as a wiping mechanism, or other mechanism for processing ink discharged from the print head in the ink jet printing apparatus, while satisfying the following requirements. The first requirement is that a large space to accommodate a liquid to be supplied to this mechanism is not required; the second is that the user is free from a cumbersome operation or from an increased running cost; and the third is that the ink processing does not depend on environment.

In a first aspect of the present invention, there is provided an ink jet printing apparatus to form an image by using a print head for ejecting ink, comprising: means for cooling the atmosphere and capable of producing water by the cooling; wherein the water thus produced is supplied to an ink coming out of the print head.

In a second aspect of the present invention, there is provided an ink jet printing apparatus to form an image by using a print head for ejecting ink, comprising: cooling means capable of producing water by cooling the atmosphere; and processing means for supplying the water to an ink produced either by ejecting ink from the print head in other than a printing operation or by applying a pressure to the print head to forcibly discharge ink; wherein the processing means includes a cap for receiving the ink, an absorbent for absorbing and retaining the ink, and a path for delivering the ink from the cap toward the absorbent; and wherein the cooling means is provided at an ink introducing portion of the absorbent to which the path is connected, and mixes the water in the ink delivered.

In a third aspect of the present invention, there is provided an ink jet printing apparatus to form an image by using a print head for ejecting ink, comprising: cooling means capable of producing water by cooling the atmosphere; and processing means for supplying the water to an ink ejected outside an edge of a print medium when a printing that leaves no margin at the edge is performed; wherein the processing means includes an ink receiver for receiving the ink ejected outside the edge and an absorbent for absorbing and retaining the ink; and wherein the cooling means mixes the water in the ink ejected at the ink receiver.

In a fourth aspect of the present invention, there is provided an ink processing method for an ink jet printing apparatus comprising the steps of: cooling the atmosphere a temperature not higher than a freezing point to produce ice and melting the ice into water; and supplying the water to an ink come out of an ink jet print head.

In a fifth aspect of the present invention, there is provided an ink processing method for an ink jet printing apparatus comprising the steps of: cooling the atmosphere to a temperature not higher than a dew-point temperature minus 10° C., or thereafter further by raising its temperature to produce water; and supplying the water to an ink come out of an ink jet print head.

In a sixth aspect of the present invention, there is provided a printing apparatus to form an image by using an aqueous ink supplied from a print head, comprising: means for cooling the atmosphere and capable of producing water by the cooling; wherein the water thus produced is supplied to an ink coming out of the print head.

The invention implemented in any one of the first to sixth aspects concerns the processing of ink coming out of the print head and adhering to the ejection face of the print head, or ink discharged during a preliminary ejection or a suction-based recovery operation, or ink ejected outside an edge of a print medium to perform a marginless printing or edge-to-edge printing on the print medium. During the ink processing or during a preparatory stage, the atmosphere is cooled to produce water, which is directly used. Therefore, no large space to accommodate the maintenance liquid is required; no cumbersome operations or increased running cost are imposed on the user; and a desired ink processing performance can be maintained, unaffected by the environment.

The above and other objects, effects, features and advantages of the present invention will become more apparent from the following description of embodiments thereof taken in conjunction with the accompanying drawings.

BEST MODE FOR CARRYING OUT THE INVENTION

Before proceeding to describe example embodiments of this invention, let us first explain a fundamental concept of the invention.

Considering the fact that a main component of an ink solvent is water whether in a dye-based or pigment-based ink system, the inventors of the present invention have focused attention on a fact that the wiping performed while supplying water has a substantial cleaning effect. This is because adding water to the viscous ink on the ejection face and mixing them can enhance the ink fluidity, assuring that the wiping leaves no residues on the ejection face. The inventors have also considered that a printing apparatus can be provided which does not require a large-sized reservoir or the user to perform the cumbersome processing as required in the Japanese Patent Application Laid-open No. 10-138503 if water is produced and supplied as necessary.

The inventors have come up with an idea that water can be produced from water vapor by cooling an atmosphere and then supplied directly to a maintenance mechanism for the wiping operation. More specifically, a cooling means having its cooling surface in contact with atmosphere is used and the atmosphere is cooled a temperature not higher a dew-point temperature to form dews on the cooling surface. The dews or water is then used for wiping, thus solving the problem associated with the Japanese Patent Application Laid-open No. 10-138503.

The fundamental concept of this invention differs from the technical philosophy of the conventional Japanese Patent Application Laid-open Nos. 10-138503 (1998), 2000-203037, 54-51837 (1979) and 2000-276214 in that water is produced by cooling and that the water is directly or indirectly used positively in the maintenance mechanism or others. Embodiments for achieving the above-described objective by efficiently producing and supplying water will be described as follows.

First Embodiment

Figure 1:
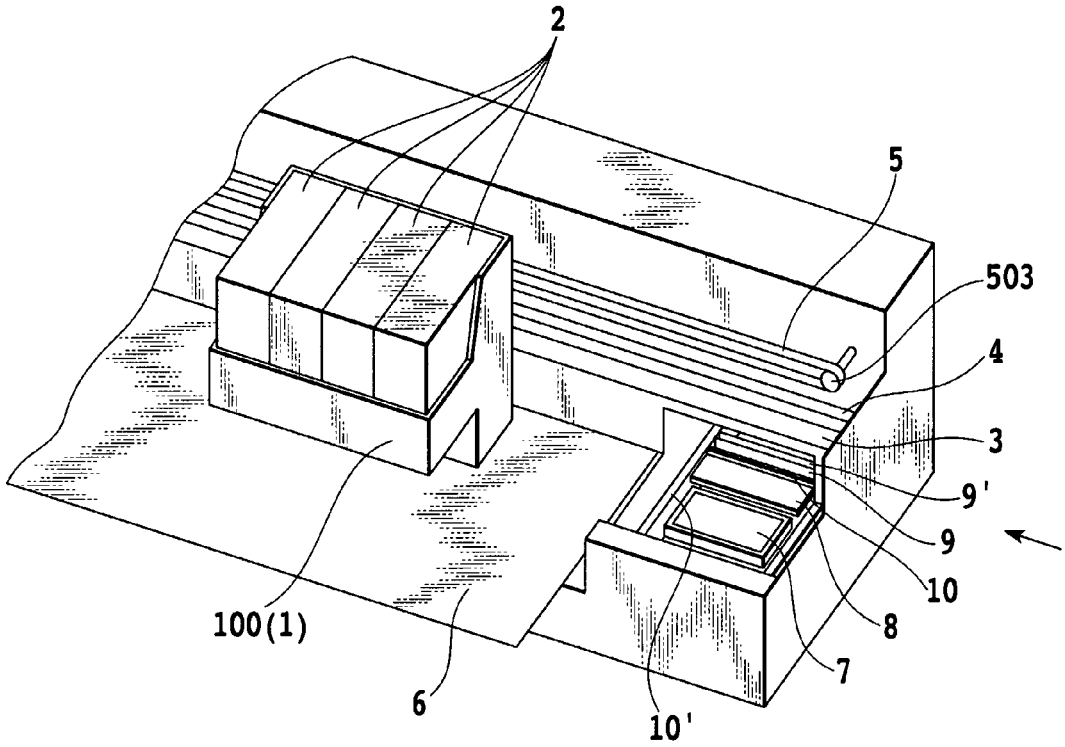
FIG. 1 is a schematic perspective view showing an essential portion of an ink jet printer as one embodiment of this invention.

FIG. 1 is a schematic perspective view showing an essential portion of an ink jet printer according to one embodiment of this invention.

In the ink jet printing apparatus shown, a carriage 100 is secured to an endless belt 5 and can be moved along a guide shaft 3. The endless belt 5 is wound around a pair of pulleys 503, one of which is coupled to a drive shaft of a carriage drive motor (not shown). Thus, the carriage 100 is reciprocally moved to the left and right along the guide shaft 3 (main scan) in this figure, as the motor is operated.

On the carriage 100 is mounted a print head 1 that removably holds an ink tank 2. The print head 1 has an array of ink ejection nozzles facing a print medium or paper P and arranged in a direction other than a main scan direction (for example, in a sub-scan direction in which the print medium 6 is fed). A set of the nozzle array and the ink tank 2 can be provided in number corresponding to that of ink colors used. In the example shown, four sets are used for four colors (e.g., black, yellow, magenta and cyan).

The print medium 6 is transported intermittently in a direction perpendicular to the scan direction of the carriage 100. The print medium 6 is supported by a pair of roller units (not shown) that are provided one on an upstream side and one on a downstream side of the transport direction and is applied a predetermined tension so that it is kept flat with respect to ejection openings as it is transported. The printing operation performed on the print medium over a width corresponding to the length of nozzle array of the print head 1 as the carriage 100 is moved and the transport of the print medium 6 are alternated repetitively to form an image on the entire print medium 6. In the printing apparatus shown, a linear encoder 4 is installed to detect a position of the carriage in the main scan direction.

The carriage 100 stops at a home position at the start of the printing operation or during the printing operation as necessary. Near the home position is installed a maintenance mechanism including a cap 7, a cooling unit 8 and a wiper blade 9. The cap 7 is supported by a lift mechanism not shown so that it can be raised or lowered. At the raised position the cap 7 caps the ejection face of the print head 1 to protect it while the print head is not activated or to perform a recovery operation by suction. During the printing operation the cap 7 is set at the lowered position where it can avoid interfering with the print head 1. It can also be positioned to oppose the ejection face to receive ink during the preliminary ejection operation.

The wiper blades 9, 9' made of an elastic material such as rubber are fixed to a wiper holder 10. The wiper holder 10 can be moved back and forth in the figure (in a direction perpendicular to the main scan direction of the print head 1). When the print head 1 reaches the home position, the wiper holder 10 can move forward in the figure to wipe the ejection face of the print head 1. After the wiping operation is finished, the print head 1 moves away from the home position, followed by the wiper holder 10 moving toward the far side of the figure to stand by for the next wiping operation.

Figure 2:
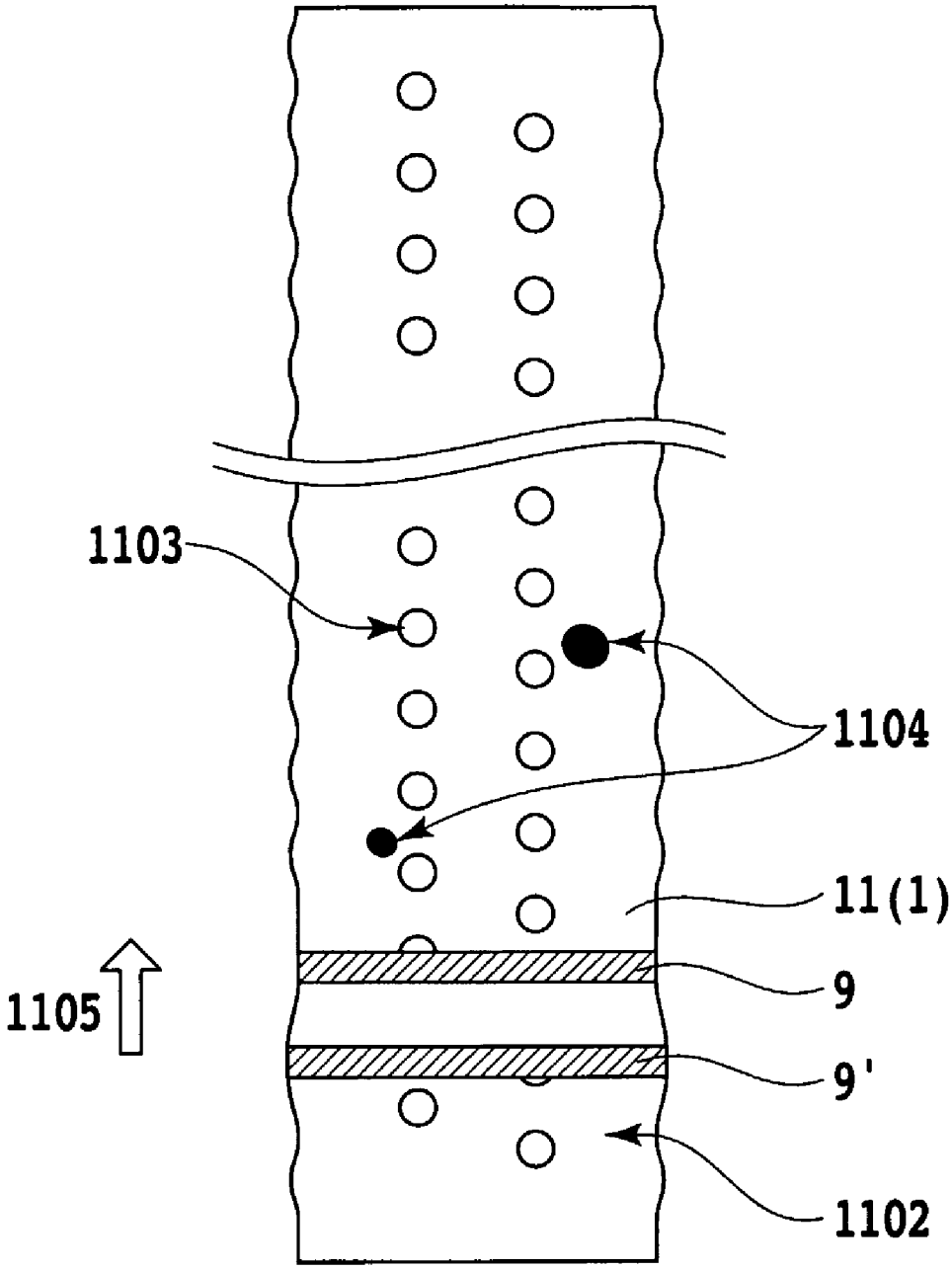
FIG. 2 is a schematic diagram showing a part of the print head as seen from an ejection face side, used to explain a wiping operation.

FIG. 2 shows a part of the print head 1 (a nozzle array for one color ink) as seen from the ejection face side, to explain about the wiping operation. Denoted is the ejection face, and 1103 ink ejection nozzles arrayed in the ejection face 11 in a direction different from the main scan direction (e.g., in a direction perpendicular to the main scan direction). The nozzles shown here are assigned one ink color. Denoted 1104 is ink adhering to the ejection face and likely to interfere with ink droplets flying in a straight line. An arrow 1105 represents a wiping direction. The wiping operation involves moving the wiper blades 9, 9' in the direction of arrow 1105 (in this example, in a direction perpendicular to the main scan direction) while in sliding contact with the ejection face 11 to wipe out the adhered ink on the ejection face 11 by the wiper blades 9, 9', as shown. As described later, the wiper blades 9 and 9' have different heights and, when they come into sliding contact with the ejection face 11 of the print head 1, the former bends relatively greatly as its side portion comes into contact with the ejection face 11 and the latter bends relatively slightly as its front end portion comes into contact with the ejection face 11.

Figure 3:
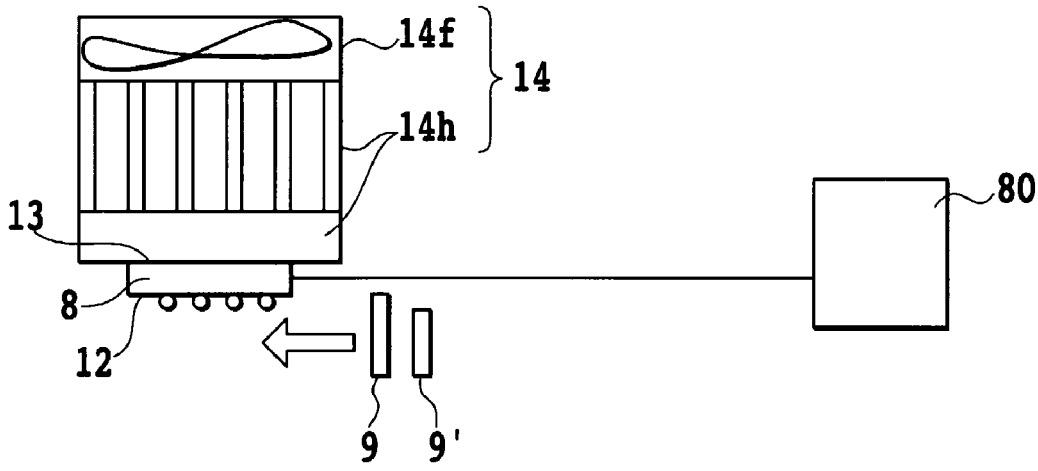
FIG. 3 is a schematic side cross-sectional view showing a cooling unit of the first embodiment and its associated portions, as seen from a direction of arrow of FIG. 1.

FIG. 3 is a schematic side cross-sectional view of the cooling unit 8 of this embodiment and its associated components, as seen from the direction of arrow of FIG. 1. The cooling unit 8 of this embodiment uses a Peltier device and is connected to a DC power source 80, with its bottom surface 12, which is wiped with the wiper blade 9, functioning as a cooling surface and with its top surface 13 functioning as a heat dissipating surface. Prior to the wiping of the print head 1, the bottom surface 12 of the cooling unit 8 is cooled. When the air in contact with the bottom surface 12 is cooled to a temperature not higher a dew-point temperature, moisture in the air is condensed into dew or frost. Then, when the print head 1 reaches the home position, the wiper holder 10 is moved forward in FIG. 1 (toward the left in FIG. 3) to wipe the ejection face 11. At this time, the water condensed on the bottom surface 12 of the cooling unit 8 or the water produced from melted frost is transferred to the wiper blades 9, 9' for smooth wiping on the ejection face 11.

On the top surface 13 as a heat dissipating surface is mounted a heat dissipating mechanism 14 which is designed to efficiently dissipate heat produced in the top surface 13. The heat dissipating mechanism 14 may be constructed in a fin structure having a large surface area and formed of a material with high heat conductivity. Or it may be combined with a fan. It is also possible to produce a heat dissipation effect from vaporization by accommodating water or organic solvent with large heat capacity in a vessel with high heat conductivity. In the example shown, a heat sink **14*h* with fins is combined with a fan 14*f***.

FIGS. 4A to 4C, FIGS. 5A to 5D and FIG. 6 are schematic side views, as seen from the direction of arrow of FIG. 1, showing the action of wipers of this embodiment during the wiping operation.

Figure 4A:
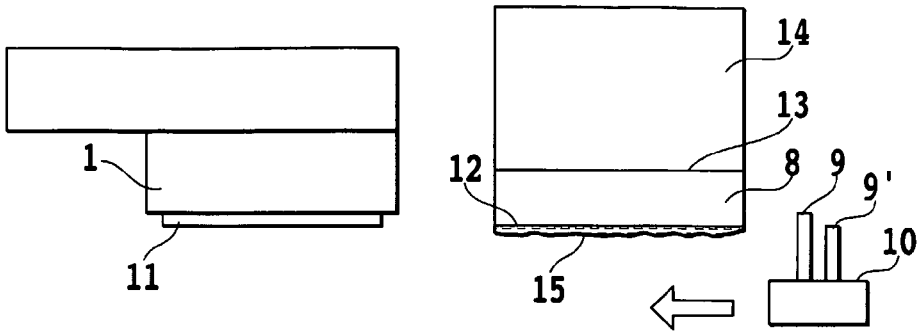
FIGS. 4A to 4C are schematic side cross-sectional views, as seen from the direction of arrow of FIG. 1, showing an operation of the first embodiment during a wiping operation.
Figure 4B:
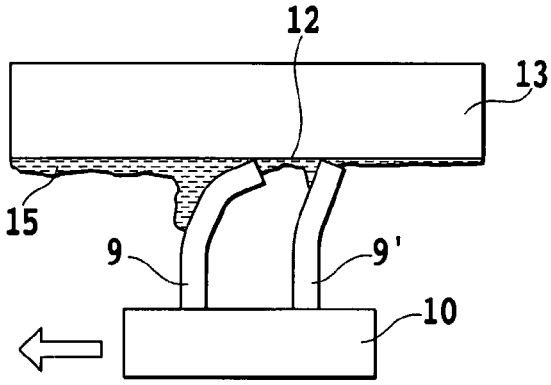

In FIG. 4A, the cooling of the bottom surface 12 of the cooling unit 8 prior to the wiping of the print head 1 condensates (or frosts) moisture in the air into water (or ice) 15 on the bottom surface 12. A surface temperature of the cooling surface 12 and a control process to obtain a desired amount of water will be described later. FIG. 4B shows the wiper blades 9, 9' moving in sliding contact with the bottom surface 12 of the cooling unit. A part of the sufficient amount of water produced on the bottom surface 12 (from dew condensation or melted ice) is transferred onto the wiper blades 9, 9'. For efficient water transfer, the cooling unit 8 may be positioned so that the wiper blades 9, 9' have a predetermined, positive protrusion distance with respect to the bottom surface 12 of the cooling unit as the wiper blades move along the guide 10' of FIG. 1. That is, as shown in FIG. 4A, the position of the cooling unit 8 is determined such that, in a state where no external force is acting on the wiper blades 9, 9', their front ends protrude into a plane of the bottom surface 12 by an appropriate distance.

Figure 4C:
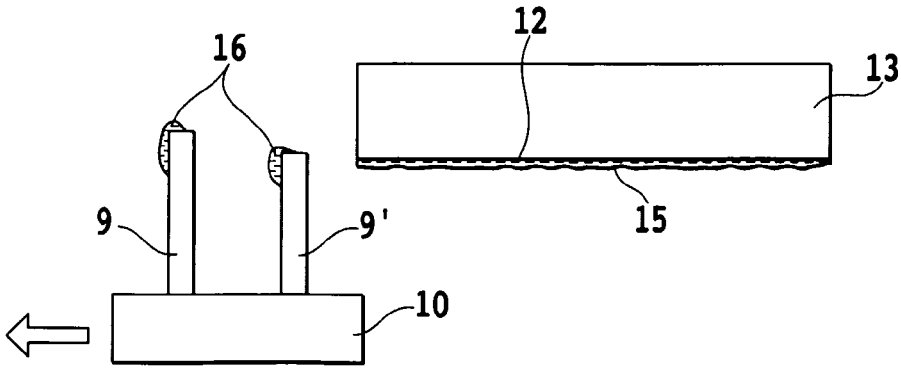

FIG. 4C shows the wiper holder 10 having moved further toward the print head 1 side and beyond the cooling unit 8. The wiper blades 9, 9' are shown attached with water 16, a part of the water 15 produced on the bottom surface 12 which has transferred onto the blades.

Figure 5A:
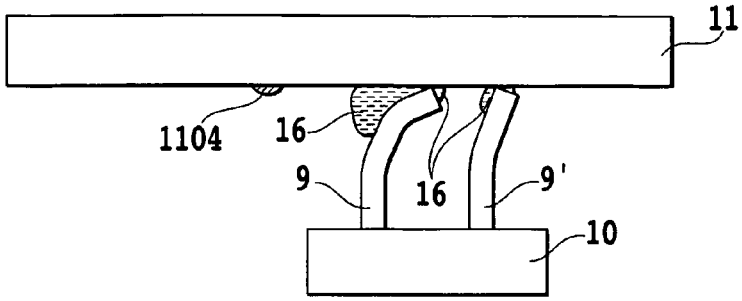
FIGS. 5A to 5D are schematic side cross-sectional views, as seen from the direction of arrow of FIG. 1, showing the operation of the first embodiment during the wiping operation.

FIG. 5A shows the wiper holder 10 having moved to under the ejection face 11 of the print head 1. The print head 1 and the wiper blades 9, 9' are positioned relative to each other so that when the wiper blades 9, 9' move along the guide 10' of FIG. 1, the wiper blades 9, 9' have a predetermined, positive protrusion distance with respect to the ejection face 11. That is, the relative positions of the print head 1 and the wiper blades 9, 9' are determined so that when no external force is acting on the wiper blades, their front end portions protrude into the plane of the ejection face 11 by an appropriate distance. The wiper blades 9 and 9' have different heights and, when they come into sliding contact with the ejection face 11 of the print head 1, the former bends relatively greatly as its side portion comes into contact with the ejection face 11 and the latter bends relatively slightly as its front end portion comes into contact with the ejection face 11. Then, when they are further advanced, the relatively long wiper blade 9 first comes into sliding contact with the ejection face 11, followed by the relatively short wiper blade 9'.

Figure 5B:
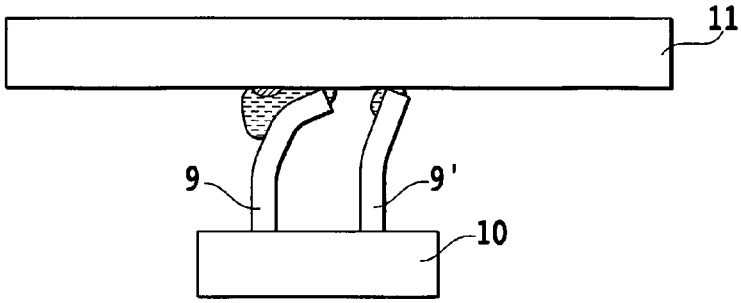
Figure 5C:
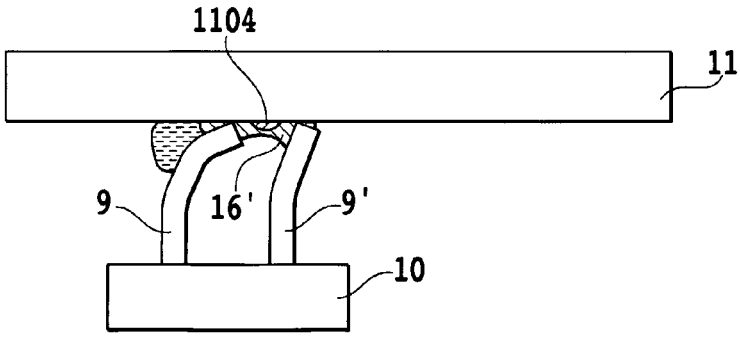
Figure 5D:
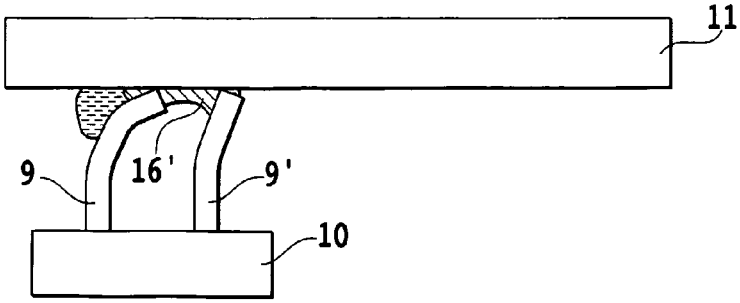

There may be viscous ink 1104 adhering to the ejection face 11, as shown in FIG. 2. When a pigment-based ink is used, a high molecular compound used to disperse pigment may adhere to the ejection face. In addition to the physical cleaning to wipe off adhering ink, this embodiment also performs a chemical cleaning. That is, in this embodiment the wiping of the ejection face 11 is performed by putting water 16 on the wiper blades 9 to re-dissolve (re-disperse) the viscous ink with water or to remove the high molecular compound with water. This produces an excellent cleaning effect on the ejection face 11. Particularly, as shown in FIGS. 5B to 5D, the wiper blade 9 bends relatively heavily to hold its side portion in sliding contact with the ejection face 11, efficiently transferring the water 16 onto the ejection face 11. If there is adhering ink 1104 on the ejection face 11, the added water 16 dissolves or peels away the adhering ink. Or it absorbs water and softens. In this state, an edge of the wiper blade 9' engages the ejection face 11 to efficiently scrape off the dissolved, peeled or softened viscous ink 1104, thus cleaning the print head.

Figure 6:
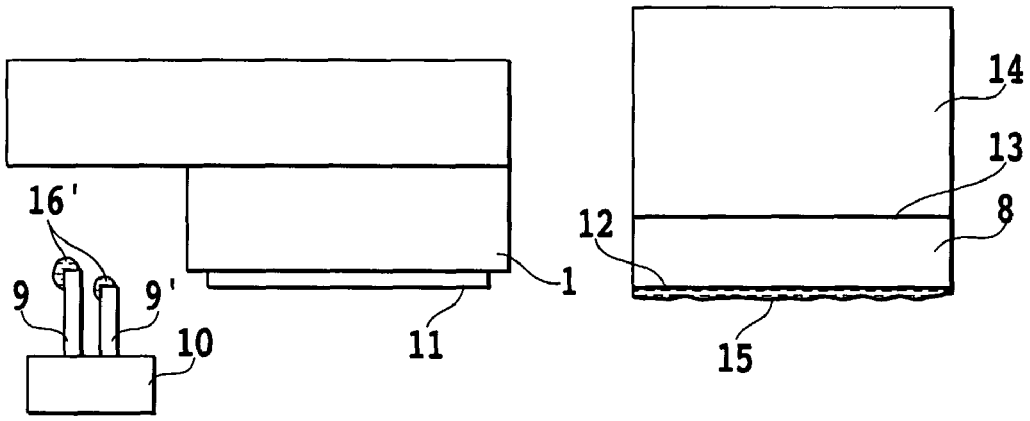
FIG. 6 is a schematic side cross-sectional view, as seen from the direction of arrow of FIG. 1, showing the operation of the first embodiment during the wiping operation.

FIG. 6 shows the wiper holder 10 having completely passed beyond the print head 1. As a result of the wiping, the wiper blades 9 have water 16' on it in which ink component is partly dissolved (including flaked or softened ink solids). If the water 16' is allowed to flow down the wiper blades 9 by gravity, a member to receive the water 16' may be provided below the wiper holder 10. It is, however, desirable to provide means (e.g., sponge or scraper) or process that engages the wiper blades 9 at or near the position shown in the figure to positively receive the water 16' from the wiper blades for their cleaning.

As described above, in this embodiment the ink solids adhering to the ejection face that cannot be removed by the normal wiping operation alone are softened or diluted with water to improve the wiping performance. In this example, water that is produced by cooling the atmosphere (or water obtained by melting ice produced by cooling the atmosphere) is directly used in wiping the ejection face. Therefore, there is no need to specially prepare a cleaning liquid for the ejection face or secure a space for accommodating the cleaning liquid. Further, the ejection face cleaning performance is improved significantly without having to particularly depend on the surrounding environment. That is, a desirable wiping can be performed semi-permanently without noise in a reduced space.

In this embodiment, it is also possible to give the underside of the cooling unit a water-repellent finish to make the water transfer to the wiper blades 9 more efficient.

Second Embodiment

The maintenance mechanism to which this invention can be applied is not limited to the wiper blade that directly contacts the ejection face 11 of the print head 1 as described in the above embodiment. This invention is also applicable to the portion that holds waste ink discharged as a result of preliminary ejection and suction-based recovery operation.

Figure 7:
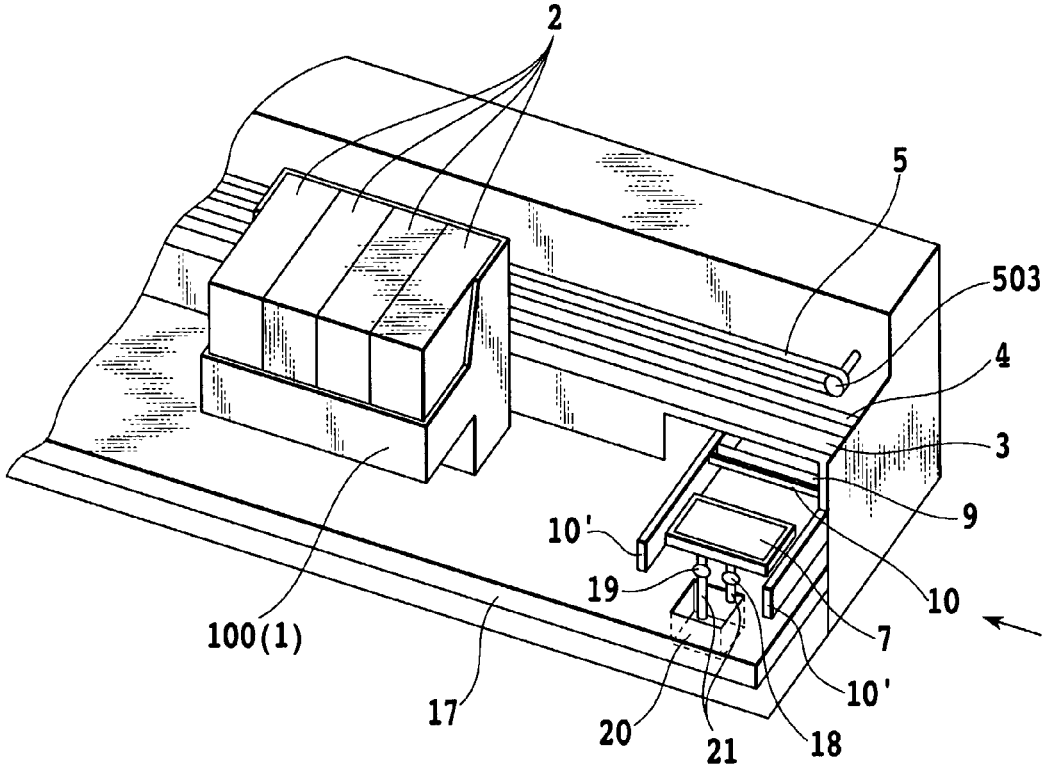
FIG. 7 is a schematic perspective view showing an essential portion of an ink jet printer according to a second embodiment of this invention.

FIG. 7 is a schematic perspective view showing an essential portion of an ink jet printer according to the second embodiment of the invention. This example has an almost similar construction to that of FIG. 1 and components similar in structure to those of the first embodiment (FIG. 1) are assigned like reference numbers. In the following embodiments, although only one wiper blade (reference number 9) is shown, two of them may of course be provided as in the first embodiment.

Figure 8A:
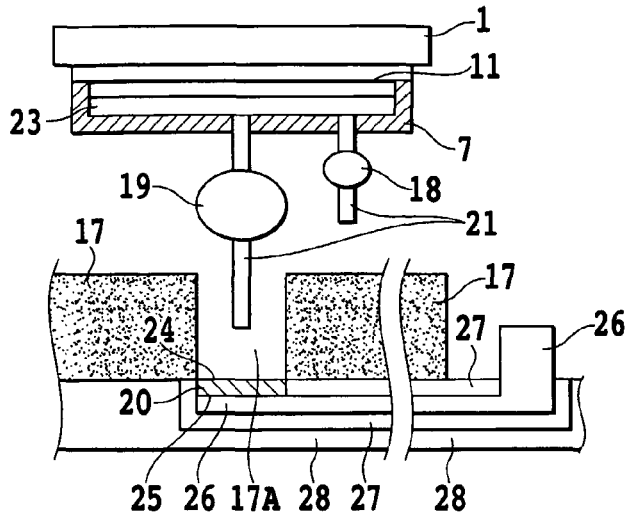
FIGS. 8A and 8B are schematic side views showing an essential portion of the second embodiment, as seen from a direction of arrow of FIG. 7.
Figure 8B:
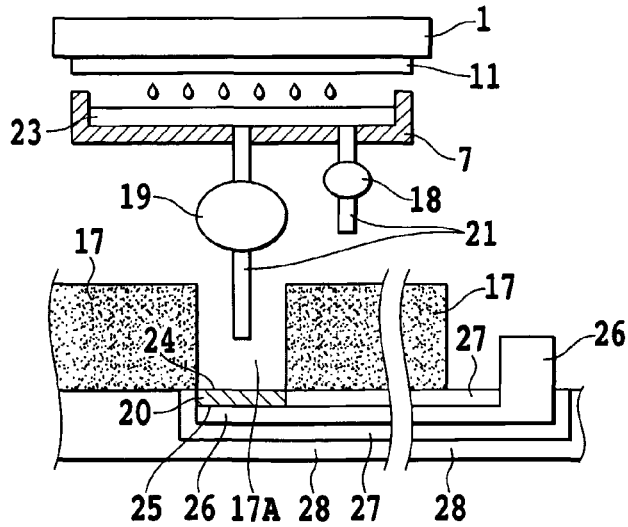

FIGS. 8A and 8B are schematic side views of an essential portion of this embodiment, as seen from the arrow of FIG. 7.

Two tubes 21 are connected to a cap 7. One of the tubes has a leakage valve 18 inserted in its path and the other has a suction pump 19 installed in its path. The leakage valve 18 is an open-close valve capable of communicating the interior of the cap 7 with the atmosphere and is normally closed. Immediately before causing the cap 7 to come into hermetic contact with the ejection face 11 to create an airtight condition and immediately before causing the cap 7 to part from the ejection face 11 to break the airtight condition, the leakage valve 18 is opened to communicate the inner space of the cap with the atmosphere. This prevents a sharp pressure variation in the inner space of the cap that would otherwise occur when the cap 7 made of an elastic member such as rubber engages or parts from the ejection face 11, ensuring that air is not pushed into the nozzles or ink is not sucked out from the nozzles. Denoted 23 is an absorbent installed inside the cap 7.

With the cap 7 placed in hermetic contact with the ejection face 11 to form an airtight space therein, the suction pump 19 creates a negative pressure in the cap 7, as shown in FIG. 8A. This causes the ink in the print head 1 to be sucked out and then discharged through one tube 21.

The suction pump 19 may be of a tube pump type. This pump comprises: a member with a curved surface along which to hold the tube 21 (at least a part of it) having flexibility; a roller that can be pressed against the flexible tube; and a roller support that supports the roller and is rotatable. That is, the roller support is rotated in a predetermined direction to cause the roller to rotate and be pressed against the flexible tube on the curved surface member. As a result, a negative pressure is produced in a hermetic space in the cap 7, drawing ink out of the ejection openings. The ink is then drawn from the cap 7 through the tube into the suction pump, from which it is further delivered toward an appropriate member (waste ink absorbent 17).

In addition to the suction-based recovery operation, the suction pump 19 can also be operated to discharge ink that was ejected into the cap 7 during the preliminary ejection operation with the cap 7 disposed opposite the ejection face 11, as shown in FIG. 8B. That is, when the ink ejected by the preliminary ejection and held in the cap 7 reaches a predetermined volume, the suction pump 19 is operated to deliver the ink from the cap 7 through the tubes 21 to the waste ink absorbent 17.

An outlet of the tube 21 connected with the suction pump 19 is disposed in a waste ink introducing cavity 17A formed in the waste ink absorbent 17. In this embodiment, a cooling unit 20 is installed on the bottom surface of the cavity 17A.

Although the cooling unit 20 may use a Peltier device as with the cooling unit 8 of the first embodiment, the cooling unit 20 of this embodiment is connected to a power supply not shown so that its upper surface 24, which opposes the outlet of the tube 21 and is disposed in the cavity 17A, serves as a cooling surface and its bottom surface 25 as a heat dissipating surface. Further, the heat dissipating surface is connected with a part of a heat dissipating mechanism 26 for efficient heat dissipation. The heat dissipating mechanism 26 is covered with a heat insulating material 27 and runs through a structural member 28 of the printer, with its end on the opposite side of the cooling unit 20 placed in contact with the atmosphere. The heat dissipating mechanism 26 is formed of a material with high heat conductivity and a part of the mechanism 26 may be constructed in a fin structure with a large surface area or combined with a fan, as in the heat dissipating mechanism 14 of the first embodiment. Further, it may be constructed as a vessel with high heat conductivity to accommodate water or organic solvent with large heat capacity.

FIGS. 9A to 9D are enlarged views of a waste ink introducing portion of the waste ink absorbent 17, showing status changes over time as the cooling unit 20 is operated.

Figure 9A:
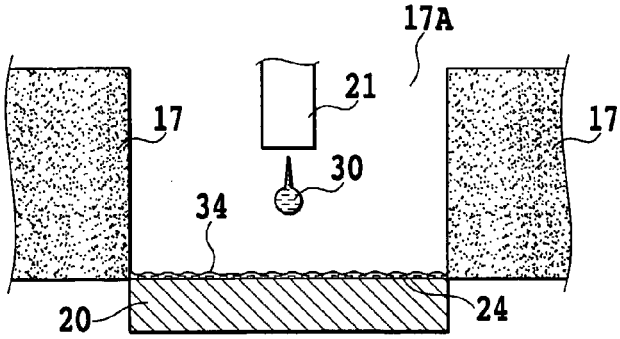
FIGS. 9A to 9D are enlarged views of a waste ink introducing portion and its associated parts in the second embodiment, showing state changes over time when the cooling unit is operated.

FIG. 9A represents a state in which water 34 is produced on the cooling surface 24 as a result of operating the cooling unit 20 prior to discharging ink 30 from the tube 21.

Figure 9B:
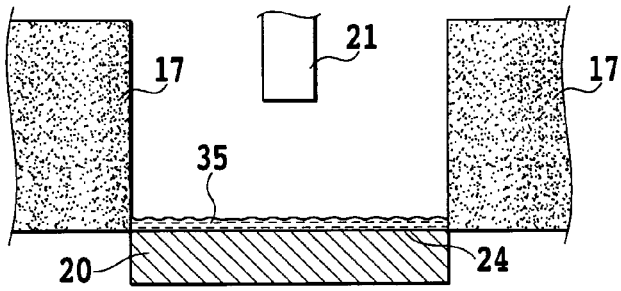
Figure 9C:
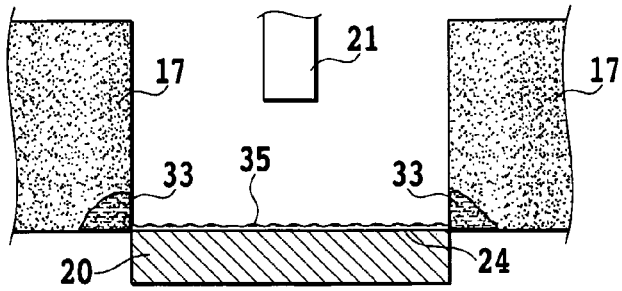
Figure 9D:
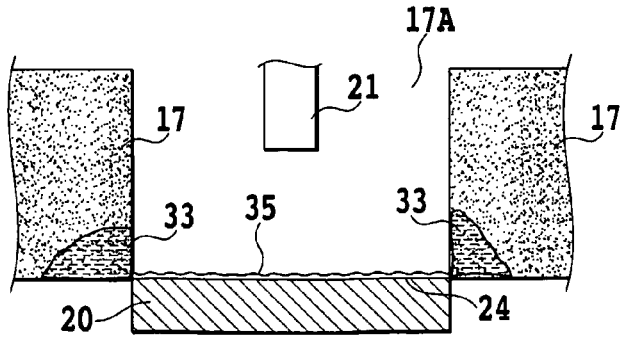

In this embodiment, when the ink 30 dripping from the tube 21 falls onto the water 34 on the cooling surface 24, the ink spreads over the entire surface of the cooling unit 20 by the action of surface tension and becomes mixed with water to form an ink mixture 35, as shown in FIG. 9B. The ink mixture 35 is at least partly in contact with the waste ink absorbent 17 and is therefore absorbed into the waste ink absorbent 17, as indicated at in FIG. 9C. In this state, if the operation of the cooling unit 20 is continued, water is produced on an interface between the ink mixture 35 and the atmosphere and on an area of the cooling surface 24 that is not covered with the ink mixture, thus increasing a water content of the ink mixture 35 and reducing its viscosity. This facilitates the absorption and diffusion of the ink mixture 35 into the absorbent 17, as shown in FIG. 9D. With this process repeated, most of the components of the ink 30 is transferred into the absorbent 17. Even after the operation of the cooling unit 20 is stopped, an increase in viscosity and an accumulation of solidified ink deposits on the cooling surface 24 or in the cavity 17A are almost prevented. If the operation of the cooling unit 20 is continued, a temperature of the cooling surface 24 is preferably set to a temperature higher than that at which the ink mixture 35 does not freeze but lower than +5° C.

Let us consider a case where the cooling unit of this embodiment is not operated. That is, suppose the cooling unit 20 does not exist or that the absorbent is also present where ink 30 drips. In this case, ink droplets simply become viscous, coagulate and solidify, degrading the absorbing capacity of the absorbent. In this embodiment, on the contrary, if the ink droplet becomes viscous immediately or to some extent, water is positively produced at an ink dripping portion and mixed with the ink to lower the ink viscosity. This facilitates the absorption of ink into the waste ink absorbent 17, eliminating the possibility that the viscous ink or solidified ink may accumulate progressively at the ink dripping portion and eventually block the ink introducing portion of the waste ink absorbent.

Therefore, the invention disclosed here uses water as it is produced by cooling the atmosphere at the waste ink introducing portion and mixes it with the ink at that portion to lower the ink viscosity, thereby allowing the ink to be transferred to the waste ink absorbent 17 efficiently. That is, the possibility can be substantially reduced that the waste ink absorbent near the ink introducing portion may get blocked with the viscous ink or solidified ink causing a problem of reduced ink absorption/diffusion efficiency or waste ink overflow.

Third Embodiment

The present invention can be applied not only to the maintenance mechanism for keeping the ink ejection performance of the print head 1 in good condition as explained in the first and second embodiments, but also to other means to process ink that has come out of the print head 1.

Figure 10:
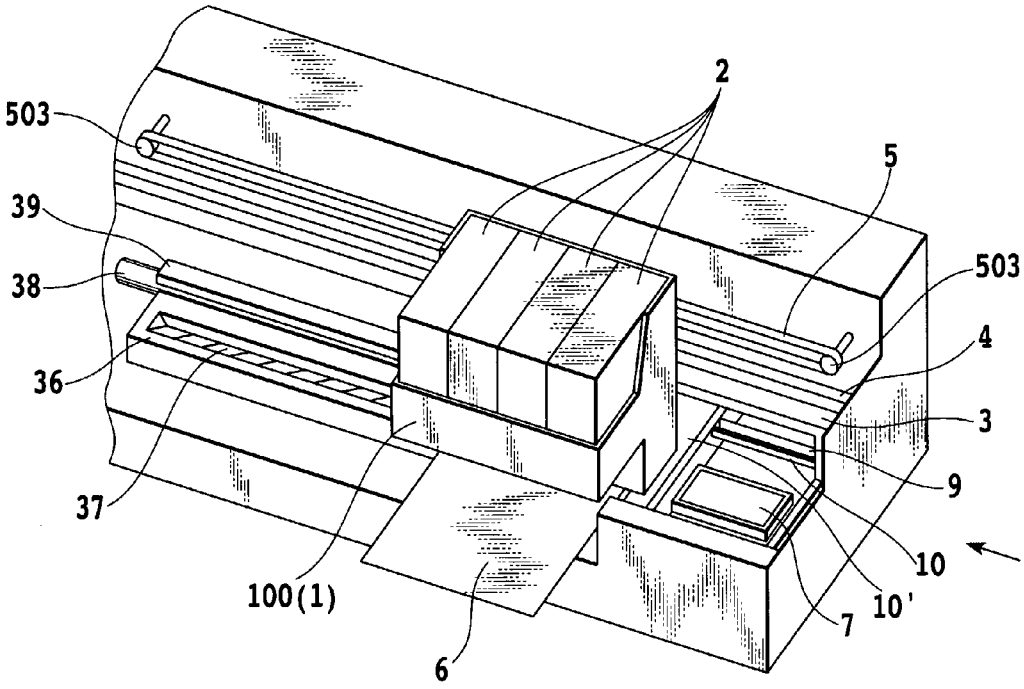
FIG. 10 is a schematic perspective view showing an essential portion of an ink jet printer according to a third embodiment of this invention.
Figure 11:
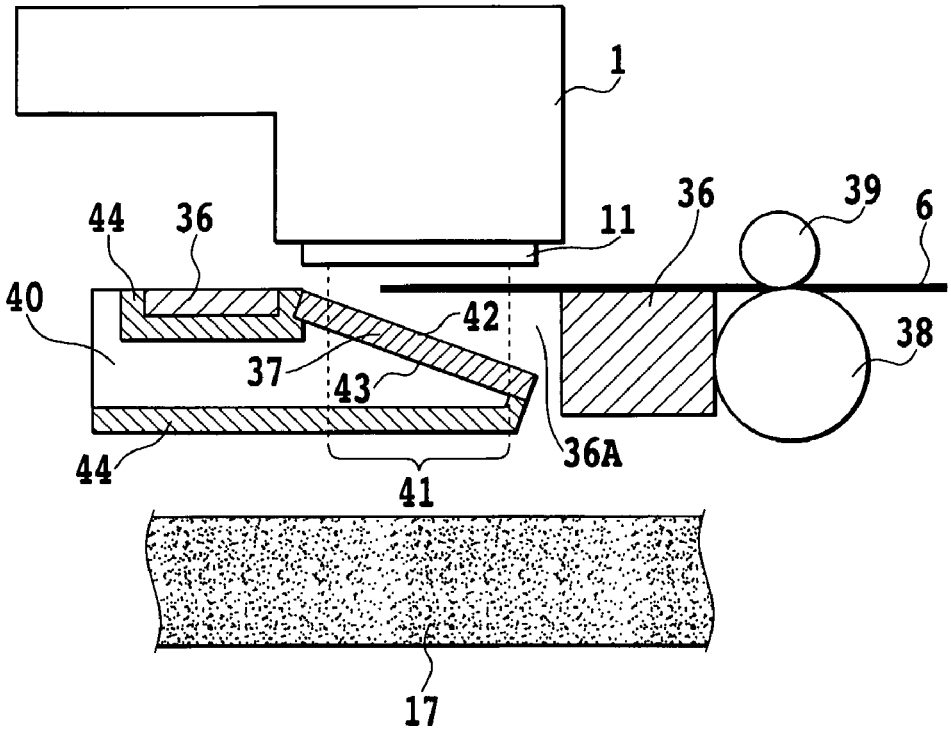
FIG. 11 is a schematic side cross-sectional view showing an essential portion of the third embodiment, as seen from the direction of arrow of FIG. 10.

FIG. 10 is a schematic perspective view of an essential portion of an ink jet printer according to still another embodiment of this invention. This example has almost the same construction as that of FIG. 1 and components that are similar in construction to those of the first embodiment (FIG. 1) are assigned like reference numbers. Further, FIG. 11 is a schematic side cross-sectional view, as seen from the direction of arrow in FIG. 10.

In these figures, reference numbers 38 and 39 represent a pair of transport rollers provided on an upstream side in a transport path of a print medium 6. Denoted 36 is a platen to support the print medium 6 in an area facing the ejection face 11 of the print head 1. The platen 36 is formed with an opening 36A which receives ink that is ejected to areas overrunning from the front, rear and side edges of the print medium 6 during an edge-to-edge printing (or marginless printing) on the print medium 6. In this example, a cooling unit 37 is installed inclined in the opening 36A with respect to the print medium transport surface so that ink droplets ejected to the overrunning areas outside the edges of the print medium 6 during the marginless printing land on the cooling unit 37. An area denoted 41 in the figure is a range in which ink may be ejected.

The cooling unit 20, as in the cooling unit 8 of the first embodiment, may use a Peltier device and is connected to a power supply not shown so that its upper surface 42, a surface that receives ink ejected outside the print medium 6, serves as a cooling surface and its bottom surface 25 as a heat dissipating surface. Further, the heat dissipating surface is connected with a part of a heat dissipating mechanism 40 for efficient heat dissipation. The heat dissipating mechanism 40 is covered with a heat insulating material 44 over a surface that contacts the platen 36 and over a surface facing the waste ink absorbent 17. The heat dissipating mechanism 40 is in contact with the atmosphere only at the front side of the printer. The waste ink absorbent 17 may be formed integral with or separate from the waste ink absorbent described in connection with the second embodiment that absorbs and retains waste ink produced by the preliminary ejection operation and the suction-based recovery operation. The heat dissipating mechanism 26 is formed of a material with high heat conductivity and a part of the mechanism 26 may be constructed in a fin structure with a large surface area or combined with a fan, as in the heat dissipating mechanism 14 of the first embodiment. Further, it may be constructed as a vessel with high heat conductivity to accommodate water or organic solvent with large heat capacity.

FIG. 12A to FIG. 12F are enlarged views of the waste ink introducing portion and its associated parts for introducing the waste ink produced during the marginless printing and show status changes over time as the cooling unit 37 is operated.

Figure 12A:
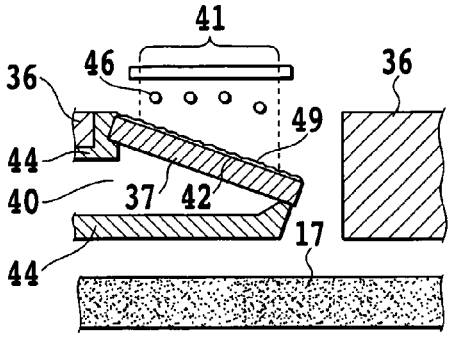
FIGS. 12A to 12F are enlarged views of a waste ink introducing portion and its surroundings for introducing waste ink produced by a marginless printing, showing state changes over time when the cooling unit of the third embodiment is operated.

FIG. 12A shows a state in which water 49 is produced on the cooling surface 42 as a result of operating the cooling unit 37 before ink droplets 46 fall from the ejection openings of the ejection face 11 onto the upper surface (cooling surface) 42 of the cooling unit 37.

Figure 12D:
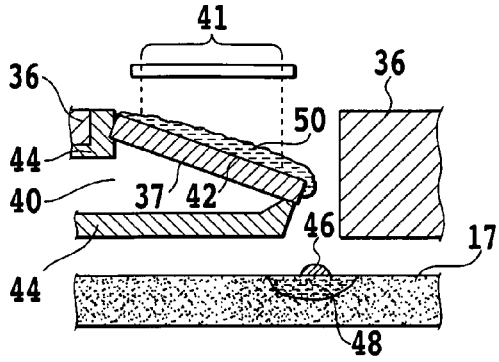
Figure 12B:
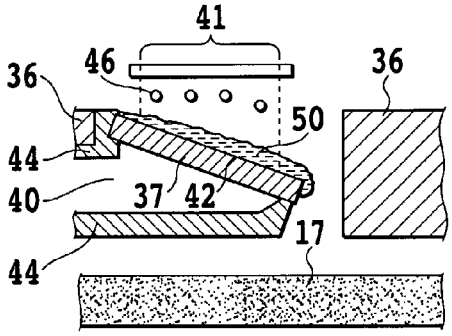
Figure 12E:
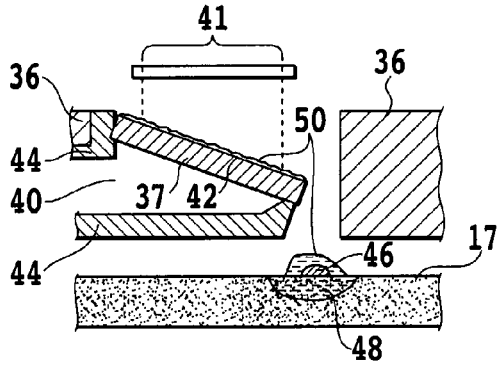
Figure 12C:
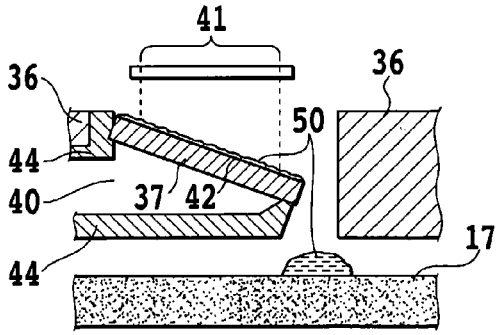
Figure 12F:
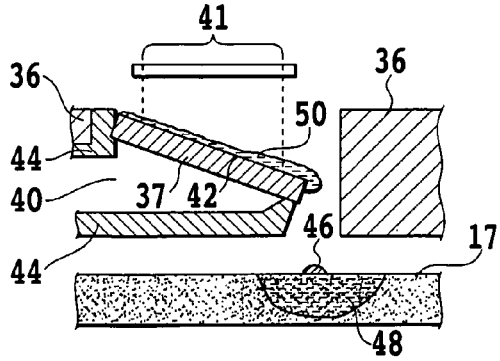

When the ink droplets 46 fall onto the water 49, the ink spreads over the entire upper surface 42 of the cooling unit 37 and to the side surfaces of the cooling unit 37 by the action of surface tension and becomes mixed with water to form an ink mixture 50, as shown in FIG. 12B. The ink mixture 50, when mixed with water, becomes less viscous and has a higher surface tension, so a relatively large portion of it flows down the inclined cooling surface and falls onto the waste ink absorbent 17 by gravity (FIG. 12C). It is assumed that from this state onward, the ejection of ink droplets is halted.

The ink mixture that has landed on the waste ink absorbent 17, as shown in FIG. 12D, infiltrates into the absorbent 17 but a part of it may remain on the surface as a viscous ink 46. If in this state the operation of the cooling unit 37 is continued, water is produced on an interface between the ink mixture 50 and the atmosphere and on an area of the upper surface 42 of the cooling unit 37 that is not covered with the ink mixture, thus increasing the amount of ink mixture on the upper surface 42. Here, if the operation of the cooling unit 37 is continued, a temperature of the cooling surface 24 is preferably set to a temperature higher than that at which the ink mixture 50 does not freeze but lower than +5° C. The ink mixture 50 in this state has a larger water content than that of the ink mixture shown in FIG. 12B, a lower viscosity and a higher surface tension, so a greater portion of the ink mixture falls onto the waste ink absorbent 17 (FIG. 12E). This fallen ink mixture 50 has a large water content and therefore a strong tendency to re-dissolve (re-disperse) the viscous ink 46 on the waste ink absorbent 17. This facilitates the absorption and diffusion of the ink mixture 50 into the absorbent 17, and therefore the volume of the viscous ink 46 remaining on the surface after the ink mixture 50 has been soaked into the waste ink absorbent 17 or dried is smaller than that shown in FIG. 12D (see FIG. 12F). With this process repeated, the ink mixture on the upper surface 42 of the cooling unit 37 now has a composition very close to that of water. Thus, if the operation of the cooling unit 37 is stopped, almost no accumulation of the solidified ink will occur as long as new ink droplets are not supplied.

If the above embodiment is not used, the ink ejected onto the inclined surface or the upper surface 42 of the cooling unit 37 remains there, becomes more viscous, coagulates and solidifies, forming a deposit of solid ink which will increase in height and eventually exceed the plane of the platen 36. This will smear the back of a print medium, block the print medium transport path or cause ink leakage in a direction other than the direction toward the absorbent 17. Even if the absorbent is installed inside the opening 36A, it is unavoidable that viscous ink or solidified ink will progressively accumulate. On the contrary, this embodiment produces water by cooling the air at the portion that receives ink ejected outside the print medium during the marginless printing. The water thus produced is used as is and mixed with the ink at the ink receiving portion to lower the ink viscosity so that the ink can be moved efficiently onto the waste ink absorbent 17. In this embodiment, the opening 36A and the cooling unit 37 with the cooling surface may be provided only at those locations necessary to receive ink ejected outside the print medium during the marginless printing.

(Embodiment of Control for Cooling Unit)

The inventors of this invention have examined a preferable amount of water for use in the wiping of the ejection face of the construction shown in FIG. 2. A print head used in this examination has 320 nozzles, 22 μm in diameter, arrayed at 600 dpi (dots/inch) in the direction 1105. A tested ink contains a self-dispersing pigment (which has ionic functional groups directly binding to the pigment surfaces and thus can be dispersed into water without using a high molecular dispersing agent). It was found that, if there is about 0.2 mg of viscous ink 1104 in total, a satisfactory wiping performance can be achieved as long as there is more than 0.1 mg/cm of water (per unit length) in the lateral direction on the wiper blade 9. As for an ink which contains a pigment that can be dispersed in water using a high molecular dispersing agent, although an investigation has yet to be made of a relation between the amount of adhering, viscous ink and the amount of water on the wiper which allows for a good wiping performance, it is assumed that there is the similar relationship.

In the construction associated with waste ink shown in FIG. 7, a preferable amount of water to achieve the desired effect described above was investigated. It was found that, when 3 mg of ink 30 discharged from the tube 21 is supplied, the waste ink can be moved to the absorbent 17 effectively if more than 0.5 mg/cm$^2$ (per unit area) is present on the cooling surface 24 prior to the waste ink supply.

Investigations were made to determine how much water needs to be produced in the cooling unit 8 to attach the above-described amount of water. The control of the cooling unit 8 was also investigated. In the examinations, a Peltier device TM-31-1.0-2.5 of Chori Co. Ltd. (cooling surface size: 1.5 cm×1.5 cm) was used and the heat dissipating surface was bonded with two heat sinks W15-10W of Alpha Co. Ltd. To enhance the cooling effect, the heat sink portions were submerged in water. The cooling surface was bonded with a thermocouple for temperature measurement.

In an environment with a temperature of 25° C. and a relative humidity of 40% RH, the Peltier device was applied 1 V, 2 V and 3 V for 1 minute and 2 minutes each. The temperature reached (cooling surface temperature) was about +2° C., −15° C. and −20° C. for the applied voltage of 1 V, 2 V and 3 V, respectively. It took about 40 seconds from the start of voltage application until the above temperatures were reached. Immediately after the above voltage application times passed, Kim Wipe of Crecia Corporation was used to wipe the cooling surface to measure the amount of water produced. Two measurements were averaged to obtain the following result. It is noted that for the voltage application of 2 V and 3 V, frosting (icing) occurred. So, the wiping was done after waiting several seconds for the frosts to melt. In the table shown below, a blank field means that no measurement was made because the tendency can be estimated from other test results.

TABLE 1

| Applied voltage | Temperature reached | Voltage application time: 1 min | Voltage application time: 2 min |
|---|---|---|---|
| 1 V | +2° C. | 1.9 mg | 3.1 mg |
| 2 V | −15° C. | 2.7 mg | 5.5 mg |
| 3 V | −20° C. | 2.4 mg | |

Next, the amount of water produced under other environments than the above was also investigated. Three Peltier devices TM-31-1.0-2.5 (cooling surface size: 1.5 cm×1.5 cm) of Chori Co. Ltd. were used, of which two were placed in a lower tier and one in an upper tier like a pyramid. The three Peltier devices were connected in series and arranged so that the bottom surface (heat dissipating surface) of the upper-tier Peltier device can be cooled by the top surfaces (cooling surfaces) of the two lower-tier Peltier devices. A heat sink of Alpha Co. Ltd. was mounted on the bottom surfaces (heat dissipating surfaces) of the two lower-tier Peltier devices. The entire upper and lower surfaces of the two lower-tier Peltier devices were pasted with a heat conductive double-sided adhesive tape to bond the upper-tier Peltier device, the lower-tier Peltier devices and the heat sink. The heat sink was immersed in water or glycerin as necessary for an enhanced heat dissipation effect. A thermocouple was placed on the upper surface (cooling surface) of the upper-tier Peltier device and fixed with a 4 mm×9 mm heat conductive tape to measure the temperature of the cooling surface.

Three environmental levels, 15.5° C./17% RH, 30° C. /23% RH and 30° C./79% RH, were used (temperature and humidity were measured by an Assmann ventilation type thermohygrometer. In the environment of 15.5° C./17% RH, the heat sink was placed in air and immersed in water. In the environment of 30° C./23% RH and 30° C./79% RH, the heat sink was immersed in glycerin.

For varied applied voltages and voltage application times for the Peltier devices (three connected in series), the cooling surface temperature and the amount of water produced were measured under the above three environments. Measurements are shown in Table 2 to Table 5. The cooling surface in other areas than those pasted with a thermocouple fixing tape was wiped using Kim Wipe of Crecia Corporation, and the amount of water produced was measured and an average was calculated from two measurements. For the cooling surface temperature of less than 0° C., frosting (icing) occurred. So, the wiping was performed after waiting several seconds for the frosts to melt. Although the surface temperature became constant 40-60 seconds after the voltage application was started, there were cases where the temperature rose gradually because of an insufficient capacity of the heat dissipation side. In these cases the cooling surface temperature was defined to be an average of temperature from the moment the surface temperature became constant until the voltage application was stopped.

TABLE 2

| Environment: 15.5° C./17% RH; air-cooled heat sink | | | | |
|---|---|---|---|---|
| Applied voltage (V) | Voltage application time/Cooling surface temp./Amount of water generated | Voltage application time/Cooling surface temp./Amount of water generated | Voltage application time/Cooling surface temp./Amount of water generated | Voltage application time/Cooling surface temp./Amount of water generated |
| 1.8 | | | 7 min/−9° C./0 mg | |
| 2.4 | | | 7 min/−15° C./1.2 mg | |
| 3.6 | 3 min/−24° C./0 mg | | 7 min/−23° C./2.4 mg | 14 min/−22° C./4.6 mg |
| 4.5 | 3 min/−27° C./0.8 mg | 5 min/−26° C./1.3 mg | 7 min/−26° C./2.5 mg | |
| 6.0 | 3 min/−31° C./0.8 mg | 5 min/−28° C./1.6 mg | | |

TABLE 3

| Environment: 15.5° C./17% RH; water-cooled heat sink | |
|---|---|
| Applied voltage (V) | Voltage application time/Cooling surface temp./Amount of water generated |
| 4.5 | 3 min/−32° C./1.4 mg |

TABLE 4

| Environment: 30° C./23% RH; heat sink immersed in glycerin | | |
|---|---|---|
| Applied voltage (V) | Voltage application time/Cooling surface temp./Amount of water generated | Voltage application time/Cooling surface temp./Amount of water generated |
| 3.6 | | 7 min/−12° C./0.1 mg |
| 4.5 | 3 min/−22° C./0.7 mg | 7 min/−14° C./0.9 mg |
| 6.0 | | 7 min/−22° C./2.8 mg |

TABLE 5

| Environment: 30° C./79% RH; heat sink immersed in glycerin | |
|---|---|
| Applied voltage (V) | Voltage application time/Cooling surface temp./Amount of water generated |
| 2.4 | 3 min/2° C./7.8 mg |
| 3.6 | 3 min/−9° C./12.9 mg |

From the above measured results, it was found that, when the first embodiment is used under a variety of printer operation environments, a sufficient amount of water can be generated to cause more than 0.1 mg/cm of water (per unit length) in the lateral direction to adhere to the wiper blade 9. Further, the temperature of the cooling surface needs to be lower than the dew-point temperature and is preferably set a temperature not higher than the dew-point point minus 10° C. With this control, a greater amount of water can be generated in a shorter time.

There are cases that it is desired to increase the amount of water. These include a case where since there are a plurality of nozzle arrays corresponding to many colors of ink, the lateral length of the wiper blade becomes long; a case where an efficiency of water transfer through the sliding contact between the wiper and the cooling surface is considered; and a case where there is a need to deal with a mode of use such as the second or third embodiment in addition to the wiping operation. In these cases, too, the Peltier device and its associated construction may be designed based on the result of examinations to perform a desired control.

From the above results, it was confirmed that a greater amount of water is obtained by forming frost (ice) on the cooling surface in both environments with a temperature of 25° C. and a relative humidity of 40% RH and with 30° C./79% RH. This may be considered due to the fact that the initial low temperature of the cooling surface makes the water more difficult to evaporate. That is, in the environment with 25° C./40% RH, let us consider the cooling surface temperatures of 0° C. and −15° C. The amount of water generated is obviously larger for the latter cooling surface temperature than for the former if the voltage application durations are equal. Even with the cooling surface temperature of 0° C., the amount of water generated can be increased by prolonging the voltage application duration. It is, however, preferred that the cooling surface be cooled below the freezing point to freeze the condensed dews or form frost because a relatively large amount of water can be produced in a short time and because a degree of freedom of the timing control for activating the cooling unit can be expected to be increased. When the cooling surface is cooled below the freezing point, a phase of the condensed substance is to be changed from solid to liquid, or water. For this end, the voltage application to the cooling unit 8 may be stopped at an appropriate timing before the wiper blade 9 begins its sliding action in the first embodiment. Alternatively, the direction of current supplied from the power source 80 may be reversed to melt the ice formed on the bottom surface 12 of the cooling unit to change its phase to liquid.

FIGS. 13A to 13D are schematic side views showing how the wiping operation is controlled when the underside of the cooling unit is cooled below a freezing point to form frost.

Figure 13A:
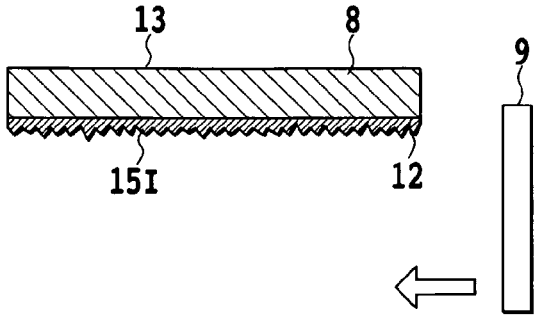
FIGS. 13A to 13D are schematic side views showing how the wiping operation is controlled when the cooling surface is cooled below a freezing point to form frost.
Figure 13B:
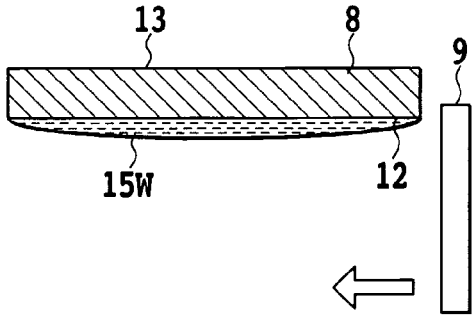
Figure 13C:
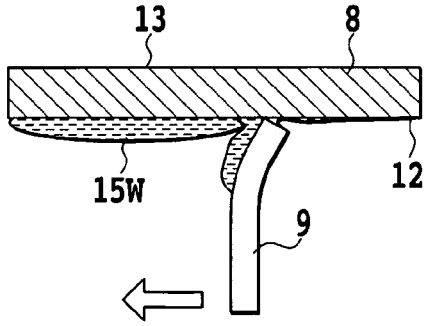
Figure 13D:
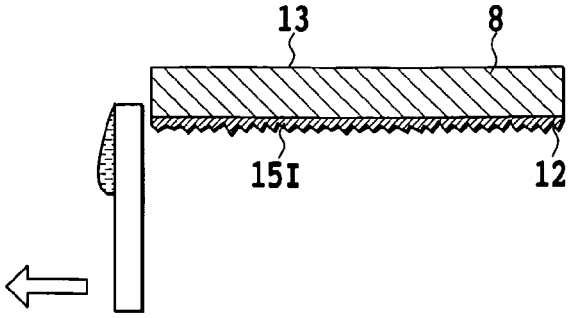

The bottom surface 12 of the cooling unit 8 or Peltier device is cooled to, for example, —15° C. to form ice or frost 15I from condensed dew (FIG. 13A). Then, immediately before the wiper blade 9 starts to move, the cooling unit bottom surface 12 is heated to melt the ice 15I into water 15W, causing a solid-to-liquid phase change (FIG. 13B). Heating may be done by stopping the current application or by reversing the direction of current to make the bottom surface of the cooling unit a heat dissipating surface. In the former case, ice is melted by heat conduction from the cooling unit upper surface (heat dissipating surface) 13. The only requirement is to make sure that a sufficient amount of heat is delivered. In the latter case, the current application is stopped when the ice melts, to prevent the melted water from evaporating before it is carried to the wiper blade 9. Next, as the wiper blade 9 moves, at least a part of the melted water is transferred to the wiper blade 9 (FIG. 13C), enabling the wiping action described above to be performed. When the wiper blade 9 passes the cooling unit 8, the cooling unit 8 may be energized again to resume the cooling operation of the bottom surface of the cooling unit to form a sufficient amount of frost for the next wiping operation (FIG. 13D).

In this embodiment, because water on the cooling surface is frozen, there is no need to provide an absorber that holds water before the sliding action of the wiper blade 9 begins. As the above examination results indicate, since a large amount of water can be produced, the amount of water transferred to the wiper blade 9 can be increased, further improving the performance of wiping the ejection face clean.

(Configuration of Control System)

A configuration of the control system and its control sequence that can suitably be employed in implementing the present invention will be explained. In the following description an example configuration conforming to the first embodiment is taken up.

Figure 14:
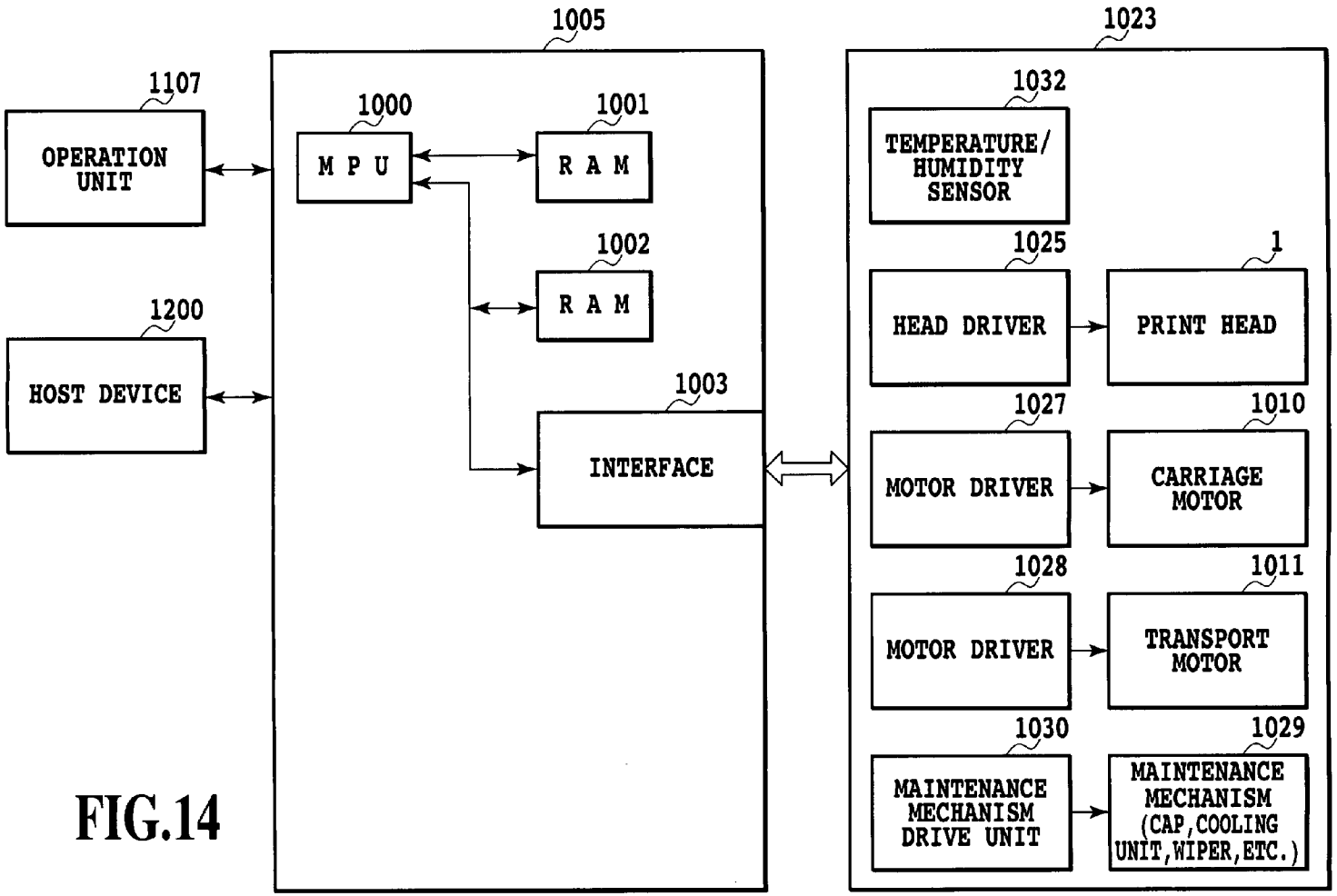
FIG. 14 is a block diagram showing an example configuration of a control system for an ink jet printer that can be applied to the first embodiment.

FIG. 14 is a block diagram showing an example configuration of an ink jet printer control system.

In the figure, denoted 1005 is a control unit which has an MPU 1000 to control various components in executing a control sequence described later with reference to FIG. 15. Denoted 1001 is a ROM storing a program for the control sequence and fixed data. It also stores data of a table T that is used to determine an operation condition of the cooling unit 8 according to an environment, particularly ambient temperature and humidity of the cooling unit 8. The control unit 1005 also has a RAM 1002 that the MPU 1000 uses as a work area when executing the control sequence.

The control unit 1005 is connected with an operation unit 1107 that includes switches for receiving user operations and a display for indicating information to the user. The control unit 1005 is also connected with a host device 1200, such as computer and digital camera, so it can receive a print instruction (command) signal and a print information signal including print data from the host device 1200. The control unit 1005 can send status information on the printing apparatus side to the host device 1200 as required.

The control unit 1005 is further connected through an interface unit 1003 to a printer unit 1023, which includes those components of the printing apparatus shown in FIG. 1 and FIG. 3. In the printer unit 1023, reference number 1025 represents a head driver to drive the print head 1; 1010 a carriage motor as a drive source to move the carriage 100 (for main scan); 1027 a motor driver to drive the carriage motor 1010; 1011 a transport motor as a drive source to feed a print medium (for subscan); 1028 a motor driver to drive the transport motor 1011; 1029 a maintenance mechanism including the cap 7, the cooling unit 8, the heat dissipating mechanism 14 and the wiper blades 9, 9'; 1030 a drive unit to drive the components of the maintenance mechanism 1029; and 1032 a temperature/humidity sensor to detect ambient temperature and humidity of the cooling unit 8.

FIG. 14 shows only those essential portions associated with the processing of this embodiment to be described later. Actually it can of course include sensors, such as a carriage home position sensor and a capping sensor, and other necessary means.

Figure 15:
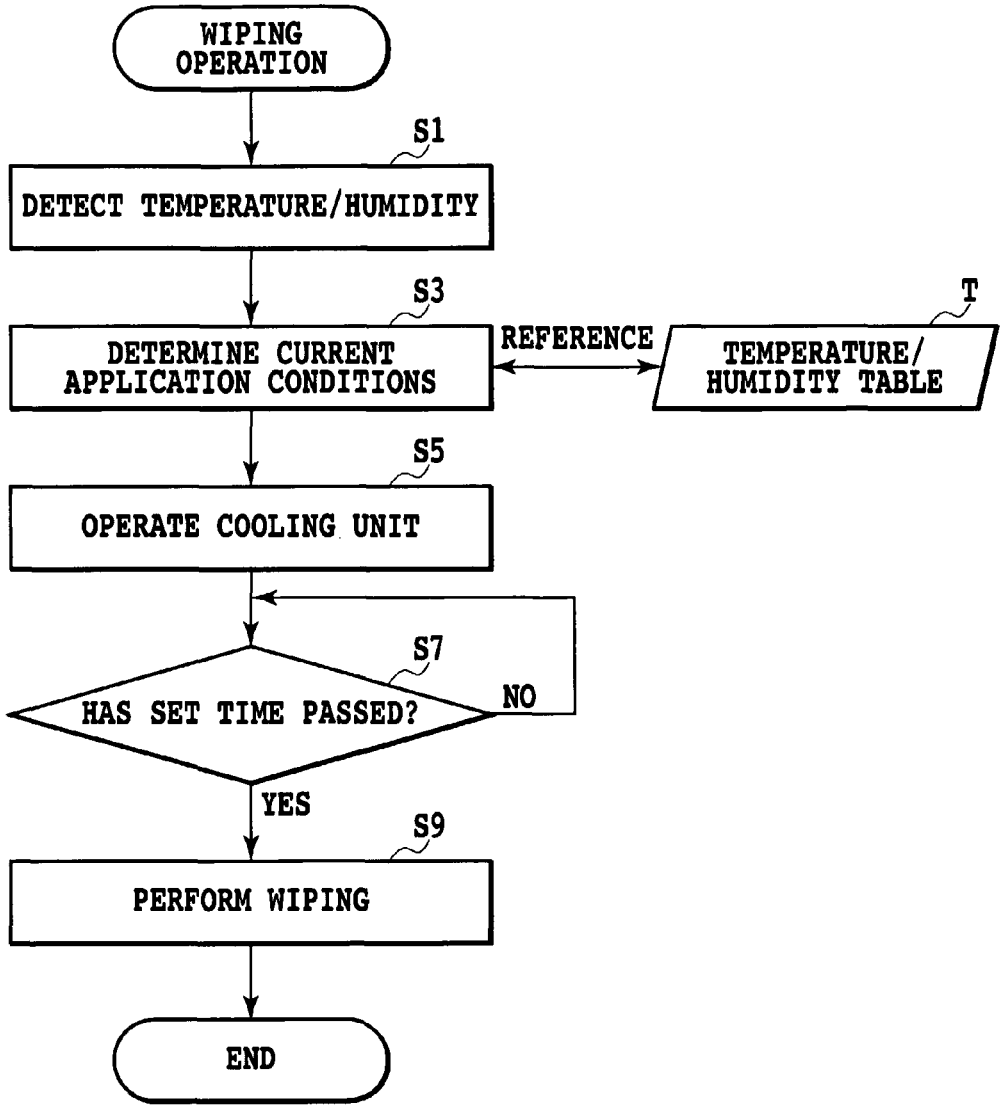
FIG. 15 is a flow chart showing an example sequence of a wiping operation applicable to the first embodiment.

FIG. 15 is a flow chart showing an example sequence of wiping operation applicable to the first embodiment. This sequence can be initiated at any desired timing. For example, it may be initiated every predetermined duration, or when the printing operation has been continued for more than a predetermined time or when a predetermined volume of ink has been ejected. This wiping sequence may also be started according to a user demand or in combination with the suction-based recovery operation or with the preliminary ejection.

When this sequence is initiated, ambient temperature and humidity are first detected by the temperature/humidity sensor 1032 (step S1). Then, based on the temperature/humidity information, the MPU 1000 refers to the table T in the ROM 1001 and determines a drive condition of the cooling unit 8, i.e., a voltage to be applied to the Peltier device and a voltage application duration, that produces the amount of water required for wiping in the shortest possible time under the detected temperature/humidity (step S3).

Next, under the drive condition thus determined the cooling unit 8 is started (step S5). When the determined voltage application duration elapses (step S7), the operation of the cooling unit 8 is stopped. If frost is formed on the surface of the cooling unit 8, it is possible to wait for ice to melt after the cooling unit 8 is stopped or to perform some operation to facilitate the melting.

After the amount of water required for wiping has been secured by the above processing, the wiping is performed (step S9). During this wiping operation, water is transferred to the wiper blade and used for wiping the ejection face clean.

Although in this sequence the drive condition of the cooling unit 8 has been described to be determined by referring to the table, it may be obtained using a predetermined calculation formula. Further, this sequence determines the drive condition after the wiping operation is initiated and then operates the cooling unit 8 accordingly. If it takes a relatively long time to obtain the amount of water required for wiping, other processing may be executed during that time. For example, if during the printing operation an event for the wiping operation occurs, the printing may be continued until at least the required amount of water is secured. If the wiping operation event occurs in other than the printing operation, the suction-based recovery operation or the preliminary ejection may be performed as required.

Further, since the amount of ink mist adhering to the ejection face correlates with the number of ejection operations, i.e., the amount of print data, the timing when a wiping operation event will occur can be estimated. Because this event timing can be estimated based on the data to be printed, the operation of the cooling unit may be started a required time duration before this event timing. This method allows the wiping operation to be executed instantly without a wait.

The wiping operation can also be executed instantly by ensuring that there is an appropriate amount of water on the cooling unit 8 at all times (which is enough for use in wiping but not enough to cause dripping from the cooling unit).

For this purpose, after the printer is turned on or the print start signal is input, the cooling unit may be kept energized at all times or driven by pulses. Or a timer may be used to turn on or off the cooling unit. Further, a feedback control may be performed to properly change the drive conditions (applied voltage and voltage application duration) according to the detected information of the temperature/humidity sensor 1032 in order to secure a necessary and sufficient amount of ink.

(Others)

In the first embodiment, water is properly produced and directly used for wiping. In the second embodiment, water is appropriately produced and directly used at the waste ink introducing portion, into which the waste ink generated as a result of the preliminary ejection or the suction-based recovery operation is introduced. Further, in the third embodiment, water is appropriately produced and directly used at the portion that receives ink ejected outside the print medium during the marginless printing. These embodiments may be used in an appropriate combination. The water can also be produced properly and used directly at other locations than these, for example, at means for cleaning the wiper blade 9 (such as sponge and scraper). Further, if water is used at two or more locations, the cooling unit to generate water may be installed at each of these locations, or some of the cooling units may be shared and water introducing paths added.

Although in the above embodiments a Peltier device is used as the cooling unit, a heat pump may be used instead. If this invention is applied to relatively large printers such as industrial printers, it is possible to cool the air by using a compressor or refrigeration cycle, depending on the size of the printer which is determined according to the purpose of use.

Further, while performing the cooling, it is also possible to put to effective use the generated heat (in the first embodiment, heat on the heat sink side), for example, as by leading the heat through a heat pipe and other members with good heat conductivity to the platen to facilitate the fixing and drying of a printed image.

Further, the amount of water produced by the operation of the cooling unit and the required time for obtaining the necessary amount of water change with the ambient conditions of the cooling unit, particularly the relative humidity. That is, the higher the relative humidity, the more efficiently the required amount of water can be secured. Therefore, the relative humidity around the cooling unit may be positively increased. This may be realized by adding an appropriate means to the printing apparatus. It is preferred that the means to be added do not increase the number of components or the size of the apparatus. For this purpose, a part of the heat sink 14*h* of the heat dissipating mechanism 14 may be extended to the waste ink absorbent to utilize waste heat to evaporate water from the waste ink absorbed in the waste ink absorbent. The printer is normally enclosed in a case and therefore its interior is close to a hermetically enclosed space. Thus, by vaporizing water the relative humidity can be enhanced.

In addition, the above embodiments directly supply the water produced by the cooling unit to the ink come out of the print head for desired processing. Rather than supplying the water produced by the cooling unit as is, the water may be mixed with other liquids before being supplied.

For example, there is a technique by which a head liquid for effectively removing ink residue adhering to the ejection face is prepared and applied to the wiping of the print head. The head liquid used during the wiping operation is stored in the printer body.

As the head liquid, nonvolatile solvents such as polyethylene glycol or glycerin is preferably used. It is noted, however, that the nonvolatile solvent changes its composition according to environment. For example, the nonvolatile solvent has a large water content through moisture absorption under a humid environment but in a low-moisture environment it evaporates water. The change in composition of the head liquid brings about a change in property, giving rise to a possibility that the head cleaning effect, an object of the head liquid, may not be fully realized.

The present invention can be suitably applied to suppressing such a compositional change in the head liquid.

Figure 16:
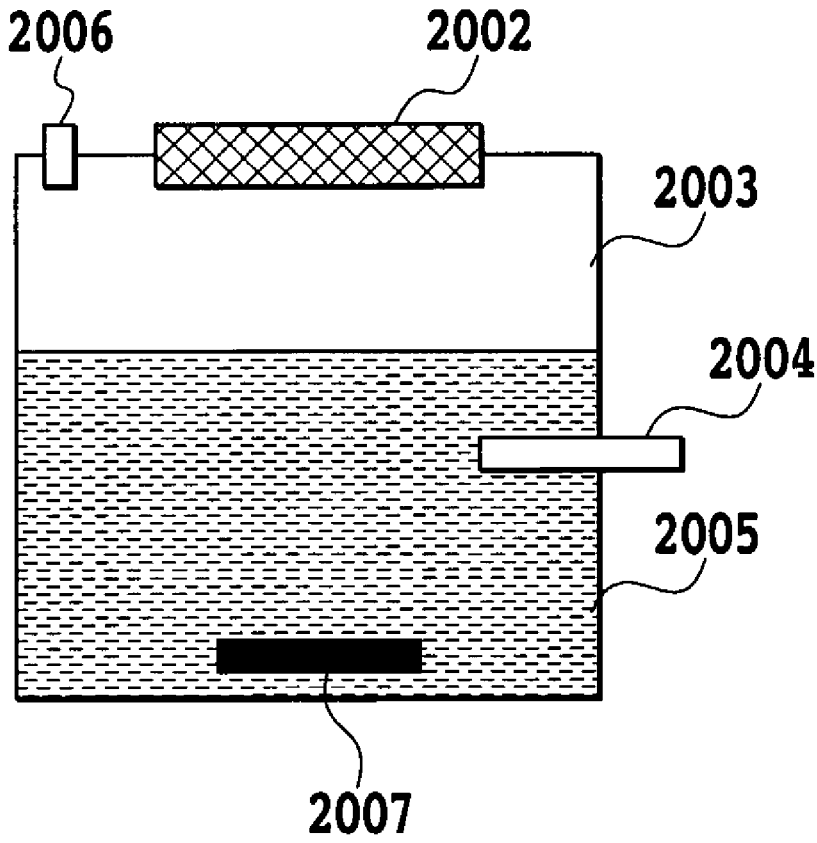
FIG. 16 is a schematic diagram showing another embodiment of this invention.

FIG. 16 is a schematic diagram showing an embodiment for implementing the above object. Denoted 2003 in the figure is a reservoir tank to accommodate a head liquid 2005 composed mainly of a nonvolatile solvent. Denoted 2006 is a communication port to communicate the interior of the tank with the atmosphere. A sensor 2004 detects a temperature and a conductivity of the head liquid 2005. By detecting the temperature and conductivity by the sensor 2004, the level of humidness/dryness of the head liquid 2005 can be known. Designated 2002 is a cooling unit using a Peltier device, with one surface (bottom surface) facing the interior of the reservoir tank 2003 and with the other surface (top surface) facing the atmosphere. Electricity to the cooling unit 2002 is controlled so that one of the surfaces of the cooling unit functions as the cooling surface and the other as a heat dissipating surface. Denoted 2007 is means for stirring the head liquid.

In this construction, when the sensor 2004 detects that the head liquid 2005 is more dried than the state in which the desired cleaning effect can be fully achieved, an electric current is supplied so that the underside of the cooling unit 2002 functions as the cooling surface. This produces water in a manner described above and causes it to drip onto the head liquid 2005 which is then stirred by the stirring means 2007 to restore the composition of the head liquid 2005 to a desired one. Conversely, if the head liquid 2005 is more moist than the state in which the desired cleaning effect can be fully achieved, the current application is performed so that the underside of the cooling unit 2002 becomes a heat dissipating surface. This lowers the relative humidity within the reservoir tank 2003, causing the water to evaporate from the head liquid 2005, thereby restoring the head liquid 2005 to a desirable composition. Then, the head liquid which is kept at a desirable performance level is brought into contact with and transferred to the wiping member 9 which is then operated to perform wiping.

As described above, the present invention can also be applied to cases where, rather than supplying water generated by the cooling unit directly to an ink come out of the print head, the water is indirectly supplied for desired processing, as by first mixing it with other liquids before being delivered.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes.

This application claims priority from Japanese Patent Application No. 2004-381748 filed Dec. 28, 2004, filed which is hereby incorporated by reference herein.

The invention claimed is:

1. An ink jet printing apparatus to form an image by using a print head for ejecting ink, comprising:

a maintenance unit configured to eject ink from the print head for maintenance of the print head or to apply a pressure to the print head to forcibly discharge ink for maintenance of the print head, wherein the maintenance unit includes a cap for receiving the ink from the print head, an absorbent for absorbing the ink, and a path for delivering the ink from the cap toward the absorbent, and a cooling unit having a Peltier device configured to cool air to produce water, wherein the cooling unit is provided at an ink introducing portion of the absorbent to which the path is connected.

2. An ink jet printing apparatus as claimed in claim 1, wherein the Peltier device has a surface and is operated such that the surface becomes a cooling surface to produce ice on the surface and then the surface becomes a heating surface to melt the ice into water.

3. An ink jet printing apparatus as claimed in claim 1, wherein the cooling surface has a temperature not higher than a dew point temperature minus 10° C.

4. An ink jet printing apparatus as claimed in claim 1, wherein the ink contains a pigment component as a colorant.

5. An ink jet printing apparatus to form an image by using a print head for ejecting ink, comprising:

a cooling unit configured to cool air to produce water; and a supplying unit configured to supply the water to an ink ejected outside an edge of a print medium when printing without a margin at the edge, wherein the processing unit includes an ink receiver for receiving the ink ejected outside the edge and an absorbent for absorbing the ink, and the cooling unit is provided at the receiver.

6. An ink jet printing apparatus as claimed in claim 5, wherein the cooling unit has a Peltier device.

7. An ink jet printing apparatus as claimed in claim 6, wherein the Peltier device has a surface and is operated such that the surface becomes a cooling surface to produce ice on the surface and then the surface becomes a heating surface to melt the ice into water.

8. An ink jet printing apparatus as claimed in claim 5, wherein the cooling surface has a temperature not higher than a dew point temperature minus 10° C.

9. An ink jet printing apparatus as claimed in claim 5, wherein the ink contains a pigment component as a colorant.

10. An ink jet printing apparatus to form an image by using a print head for ejecting ink, comprising:

a processing unit that maintains an ink ejection performance of the print head;

a cooling unit, configured to cool air, capable of producing water by the cooling;

a reservoir configured to accommodate a liquid for the print head that can be supplied to an ejection face of the print head; and a detection unit configured to detect a state of at least one of dryness and moistness of the head liquid in the reservoir unit, wherein the cooling unit has a Peltier device arranged so that one of the surfaces of the Peltier device faces an interior of the reservoir, and wherein the Peltier device is operated so that the one surface becomes a cooling surface or a heating surface according to the state of the liquid as detected by the detection unit, to supply water to the liquid or vaporize water contained in the head liquid.

* * * * *